US010962307B2

(12) United States Patent
Takahashi et al.

(10) Patent No.: US 10,962,307 B2
(45) Date of Patent: Mar. 30, 2021

(54) STACKED HEAT EXCHANGER

(71) Applicant: DENSO CORPORATION, Kariya (JP)

(72) Inventors: Eizo Takahashi, Chiryu (JP); Isao Tamada, Nagoya (JP)

(73) Assignee: DENSO CORPORATION, Kariya (JP)

( * ) Notice: Subject to any disclaimer, the term of this patent is extended or adjusted under 35 U.S.C. 154(b) by 349 days.

(21) Appl. No.: 14/770,717

(22) PCT Filed: Feb. 21, 2014

(86) PCT No.: PCT/JP2014/000901

§ 371 (c)(1),
(2) Date: Aug. 26, 2015

(87) PCT Pub. No.: WO2014/132602

PCT Pub. Date: Sep. 4, 2014

(65) Prior Publication Data

US 2016/0010929 A1 Jan. 14, 2016

(30) Foreign Application Priority Data

Feb. 27, 2013 (JP) ..... JP2013-037466
Sep. 17, 2013 (JP) ..... JP2013-191695

(51) Int. Cl.
*F28F 3/06* (2006.01)
*F28F 3/02* (2006.01)
(Continued)

(52) U.S. Cl.
CPC ..... *F28F 3/06* (2013.01); *F28D 9/005* (2013.01); *F28D 9/02* (2013.01); *F28F 3/027* (2013.01);
(Continued)

(58) Field of Classification Search
CPC ..... B60H 1/00328; B60H 1/00342; B60H 1/00921; B60H 1/3213; F28D 1/0435;
(Continued)

(56) References Cited

U.S. PATENT DOCUMENTS 3,282,334 A * 11/1966 Stahlheber ..... B01D 1/04 159/13.2
3,860,065 A * 1/1975 Schauls ..... F25J 5/002 165/166
(Continued)

FOREIGN PATENT DOCUMENTS

DE 19805439 A1 8/1999
DE 10228263 A1 1/2004
(Continued)

OTHER PUBLICATIONS

International Search Report and Written Opinion (in Japanese with English Translation) for PCT/JP2014/000901, dated May 20, 2014; ISA/JP.

*Primary Examiner* — Edward F Landrum
*Assistant Examiner* — Melodee Jefferson
(74) *Attorney, Agent, or Firm* — Harness, Dickey & Pierce, P.L.C.

(57) ABSTRACT

A stacked heat exchanger including a core portion having a plurality of plates stacked on each other to define a flat refrigerant passage and a flat heat medium passage. A first connection member that provides an inlet and an outlet for allowing the refrigerant to flow into the refrigerant passage. A second connection member that provides an inlet and an outlet for allowing the heat medium to flow into the heat medium passage, in which the inlet and the outlet are configured in a state where the heat medium flowing into the heat medium passage flows in an opposite direction to that of the refrigerant flowing in the refrigerant passage. The core
(Continued)

portion includes an offset fin disposed in at least the refrigerant passage.

6 Claims, 19 Drawing Sheets

(51) Int. Cl.
*F28F 9/02* (2006.01)
*F28D 9/00* (2006.01)
*F28D 9/02* (2006.01)
*F28D 21/00* (2006.01)

(52) U.S. Cl.
CPC ..... *F28F 9/02* (2013.01); *F28F 9/0251* (2013.01); *F28D 2021/007* (2013.01); *F28F 2250/10* (2013.01)

(58) Field of Classification Search
CPC ..... F28D 1/05391; F28D 1/05366; F28D 2021/0085; F28D 2021/0091; F28D 7/0008; F28F 9/0278; F28F 2265/16; F28F 9/0204; F28F 9/0214; F28F 9/0246; F28F 9/262; F28F 2009/0287
See application file for complete search history.

(56) References Cited

U.S. PATENT DOCUMENTS 4,282,927 A * 8/1981 Simmons ..... F28F 3/027 165/166
4,804,041 A * 2/1989 Hasegawa ..... F28D 1/0366 165/166
4,815,532 A * 3/1989 Sasaki ..... F28D 1/0333 165/152
4,869,316 A * 9/1989 Yoshida ..... F28F 3/027 165/148
5,099,912 A 3/1992 Tajima et al.
5,560,425 A * 10/1996 Sugawara ..... F28D 1/0316 165/148
5,845,505 A * 12/1998 Galus ..... F28F 3/027 62/95
6,338,384 B1 * 1/2002 Sakaue ..... F25J 3/04412 165/166
6,340,053 B1 * 1/2002 Wu ..... F28D 9/0012 165/140
6,394,178 B1 5/2002 Yoshida et al.
6,415,855 B2 * 7/2002 Gerard ..... F25J 5/002 165/146
6,739,385 B2 * 5/2004 Brenner ..... F28D 9/0037 165/166
7,469,554 B2 * 12/2008 Martins ..... F25B 39/04 165/140
8,418,752 B2 * 4/2013 Otahal ..... B21D 53/02 165/109.1
9,651,315 B2 * 5/2017 Cui ..... F28F 3/027
2001/0010262 A1 * 8/2001 Komoda ..... F28D 9/0043 165/166
2001/0054499 A1 * 12/2001 Gerard ..... F28F 3/027 165/166
2002/0066552 A1 6/2002 Komoda
2003/0010483 A1 * 1/2003 Ikezaki ..... F28F 3/083 165/174
2005/0241814 A1 11/2005 Hendrix et al.
2005/0274504 A1 12/2005 Torigoe
2006/0169445 A1 * 8/2006 Sato ..... F01M 5/002 165/153
2009/0032231 A1 2/2009 Komoda et al.
2010/0025025 A1 * 2/2010 Tomochika ..... F28F 3/027 165/166
2010/0193169 A1 8/2010 Yamada
2011/0239697 A1 10/2011 Styles et al.
2011/0290462 A1 12/2011 Andersson et al.
2012/0031593 A1 * 2/2012 Uno ..... F28D 9/0043 165/148
2012/0118542 A1 5/2012 Kanzaka et al.
2012/0234523 A1 9/2012 Jouanny et al.
2012/0234532 A1 9/2012 Kuo
2013/0146257 A1 6/2013 Kim et al.
2015/0083379 A1 * 3/2015 Ito ..... F28D 9/005 165/166

FOREIGN PATENT DOCUMENTS

EP 779481 A2 6/1997
FR 2846736 A1 5/2004
JP S62131196 A 6/1987
JP S63173685 U 11/1988
JP H0364365 U 6/1991
JP H04155191 A 5/1992
JP H05001890 A 1/1993
JP H07310958 A 11/1995
JP H09166363 A 6/1997
JP H10185462 A 7/1998
JP H11248392 A 9/1999
JP 2000337784 A 12/2000
JP 2001116485 A 4/2001
JP 2001241800 A 9/2001
JP 2002168591 A 6/2002
JP 2003185375 A 7/2003
JP 2003343993 A 12/2003
JP 2004108644 A 4/2004
JP 2005147572 A 6/2005
JP 2005337528 A 12/2005
JP 2007183071 A 7/2007
JP 2008082650 A 4/2008
JP 2009036468 A 2/2009
JP 2010078286 A 4/2010
JP 2010216793 A 9/2010
JP 2010216795 A 9/2010
JP 2011002120 A 1/2011
JP 2011002122 A 1/2011
JP 2011002146 A 1/2011
JP 2011052884 A 3/2011
JP 2011214826 A 10/2011
JP 2012107784 A 6/2012
JP 2012112591 A 6/2012
JP 2013506809 A 2/2013
JP 5194011 B2 5/2013
JP 2013518240 A 5/2013
JP 2013119382 A 6/2013
KR 20120002075 A 1/2012
WO WO-2008023732 A1 2/2008

* cited by examiner

STACKED HEAT EXCHANGER

CROSS REFERENCE TO RELATED APPLICATIONS

This application is a U.S. National Phase Application under 35 U.S.C. 371 of International Application No. PCT/JP2014/000901 filed on Feb. 21, 2014 and published in Japanese as WO 2014/132602 A1 on Sep. 4, 2014. This application is based on and claims the benefit of priority from Japanese Patent Application No. 2013-37466 filed on Feb. 27, 2013 and Japanese Patent Application No. 2013-191695 filed on Sep. 17, 2013 The entire disclosures of all of the above applications are incorporated herein by reference.

TECHNICAL FIELD

The present disclosure is related to a stacked heat exchanger in which heat is exchanged between refrigerant of a refrigerating cycle and heat medium.

BACKGROUND ART

PTL 1 to PTL 6 disclose stacked heat exchangers. In particular, PTL 1 discloses a water cooled stacked heat exchanger that can be used as a condenser.

In the stacked heat exchanger disclosed in PTL 1, a passage of refrigerant is defined between stacked plates, and irregularities are formed on the plates. However, such a shape makes it impossible to sufficiently perform heat exchange with the refrigerant. From that viewpoint and other viewpoints, a further improvement in the stacked heat exchanger has been demanded.

PTL 7 discloses a stacked heat exchanger that performs a heat exchange between a high temperature fluid and a low temperature fluid. In the stacked heat exchanger, multiple substantially tabular heat transfer plates are stacked on each other at intervals whereby high temperature fluid flow paths and low temperature fluid flow paths are alternately defined between the heat transfer plates.

In PTL 7, irregular shapes are provided on the heat transfer plates, and the respective irregularities of the adjacent heat transfer plates are brazed together. As a result, a heat transfer area is increased by an irregularly shaped portion, and a heat exchange between the high temperature fluid and the low temperature fluid can be promoted.

However, in the stacked heat exchanger disclosed in PTL 7, because the flow path shapes of the high temperature fluid flow paths and the low temperature fluid flow paths are defined by the irregularly shaped portion, the high temperature fluid flow paths and the low temperature fluid flow paths are identical in the flow path shape with each other. This makes it difficult to arbitrarily set the heat transfer area and a flow channel cross-sectional area according to the physical properties of a high temperature fluid and a low temperature fluid, and optimize the heat transfer characteristic and the pressure loss characteristic.

PRIOR ART LITERATURES

Patent Literature

PTL 1: US 2012/0234523 A1
PTL 2: JP 2005-147572 A
PTL 3: JP 2010-216795 A
PTL 4: JP H05-1890 A

PTL 5: JP H10-185462 A
PTL 6: JP 2009-36468 A
PTL 7: JP 5194011 B

SUMMARY OF INVENTION

One object of the present disclosure is to provide a stacked heat exchanger that exerts a high heat exchanging performance.

Another object of the present disclosure is to provide a stacked heat exchanger that can realize a high pressure resistance.

Still another object of the present disclosure is to provide a stacked heat exchanger that can variously change an internal flow path.

Yet another object of the present disclosure is to provide a stacked heat exchanger which is highly downsized for a refrigeration cycle.

A further object of the present disclosure is to provide a stacked heat exchanger for a refrigeration cycle, which can provide a water cooled heat exchanger and a water cooled evaporator and further has an internal heat exchange function.

According to an aspect of the present disclosure, a stacked heat exchanger includes a core portion having a plurality of plates stacked on each other to define a flat refrigerant passage for refrigerant which flows in a refrigeration cycle, and a flat heat medium passage for heat medium which performs a heat exchange with the refrigerant. The stacked heat exchanger further includes: a connection member that provides an inlet and an outlet for allowing the refrigerant to flow into the refrigerant passage; and a connection member that provides an inlet and an outlet for allowing the heat medium to flow into the heat medium passage, in which the inlet and the outlet are configured in a state where the heat medium flowing into the heat medium passage flows in an opposite direction to that of the refrigerant flowing in the refrigerant passage. The core portion includes an offset fin disposed in at least the refrigerant passage.

According to the above configuration, since the refrigerant and the heat medium flow as counter flows, an excellent heat exchange is realized. Further, the offset fin provides an excellent heat exchanging performance to the refrigerant associated with a phase change from gas to liquid or from liquid to gas. Hence, the stacked heat exchanger exerting the high heat exchanging performance is provided.

According to an aspect of the present disclosure, a stacked heat exchanger includes a heat exchanging unit that performs a heat exchange between a refrigerant of a refrigeration cycle and a heat medium. The heat exchanging unit is formed by stacking a plurality of plate members on each other, and joining the plate members to each other. A plurality of refrigerant flow channels in which the refrigerant flows, and a plurality of heat medium flow channels in which the heat medium flows are defined between the respective plate members. The plurality of refrigerant flow channels and the plurality of heat medium flow channels are arranged side by side in a stacking direction of the plurality of plate members. An inner fin that joins the adjacent plate members to each other, and facilitates a heat exchange between the refrigerant and the heat medium is disposed in each of the plurality of refrigerant flow channels and the plurality of heat medium flow channels. The inner fin disposed in the refrigerant flow channel is a refrigerant side offset fin in which a large number of cut-and-raised parts which are partially cut and raised are formed in a flowing direction of the refrigerant, and the respective cut-and-raised parts adjacent to each other in the flowing direction of the refrigerant offset each other. The inner fin disposed in the heat medium flow channel is a heat medium side offset fin in which a large number of cut-and-raised parts which are partially cut and raised are formed in a flowing direction of the heat medium, and the respective cut-and-raised parts adjacent to each other in the flowing direction of the heat medium offset each other. A refrigerant flow path height which is a length of the refrigerant flow channel in a stacking direction of the plate members is equal to a refrigerant side fin height Frh which is a length of the refrigerant side offset fin in the stacking direction of the plate members. A heat medium flow path height which is a length of the heat medium flow channel in a stacking direction of the plate members is equal to a heat medium side fin height Fwh which is a length of the heat medium side offset fin in the stacking direction of the plate members. The refrigerant side fin height Frw and the heat medium side fin height Fwh are configured to satisfy a relationship of $0.14<Frh/(Frh+Fwh)<0.49$.

According to the above configuration, the refrigerant side fin height Frw and the heat medium side fin height Fwh are set to satisfy a relationship of $0.14<Frh/(Frh+Fwh)<0.49$ with the results that the heat transfer performance between the refrigerant and the heat medium can be improved while the pressure losses of the refrigerant and the heat medium are reduced. For that reason, the heat exchanging performance can be improved.

According to an aspect of the present disclosure, a stacked heat exchanger includes a heat exchanging unit that performs a heat exchange between a refrigerant of a refrigeration cycle and a heat medium. The heat exchanging unit is formed by stacking a plurality of plate members on each other, and joining the plate members to each other. A plurality of refrigerant flow channels in which the refrigerant flows, and a plurality of heat medium flow channels in which the heat medium flows are defined between the respective plate members. The plurality of refrigerant flow channels and the plurality of heat medium flow channels are arranged side by side in a stacking direction of the plurality of plate members. An inner fin that joins the adjacent plate members to each other, and facilitates a heat exchange between the refrigerant and the heat medium is disposed in each of the plurality of refrigerant flow channels and the plurality of heat medium flow channels. The inner fin disposed in the refrigerant flow channel is a refrigerant side offset fin in which a large number of cut-and-raised parts which are partially cut and raised are formed in a flowing direction of the refrigerant, and the respective cut-and-raised parts adjacent to each other in the flowing direction of the refrigerant offset each other. The inner fin disposed in the heat medium flow channel is a heat medium side offset fin in which a large number of cut-and-raised parts which are partially cut and raised are formed in a flowing direction of the heat medium, and the respective cut-and-raised parts adjacent to each other in the flowing direction of the heat medium offset each other. The heat exchanging unit is disposed in a state where the stacking direction of the plate members intersects with a gravity direction, and the heat exchanging unit has a U-turn portion that U-turns the flow of the refrigerant circulating in the refrigerant flow channel.

According to the above configuration, with the provision of the U-turn portion that U-turns a flow of refrigerant flowing in the refrigerant flow channel in the heat exchanging unit, after the refrigerant diffused once in the refrigerant flow channel before being U-turned is congregated, the refrigerant can be further diffused in the refrigerant flow channel after being U-turned. Further, with the placement of the heat exchanging unit having a stacking direction intersecting with a gravity direction, the liquid-phase refrigerant can be separated by the gas-liquid density difference. With the above configuration, the heat transfer performance can be improved by ensuring the flow channel area (effective heat transfer surface) of the refrigerant flow channel in which the gas-phase refrigerant flows. For that reason, the heat exchanging performance can be improved.

DESCRIPTION OF EMBODIMENTS

Figure 1:
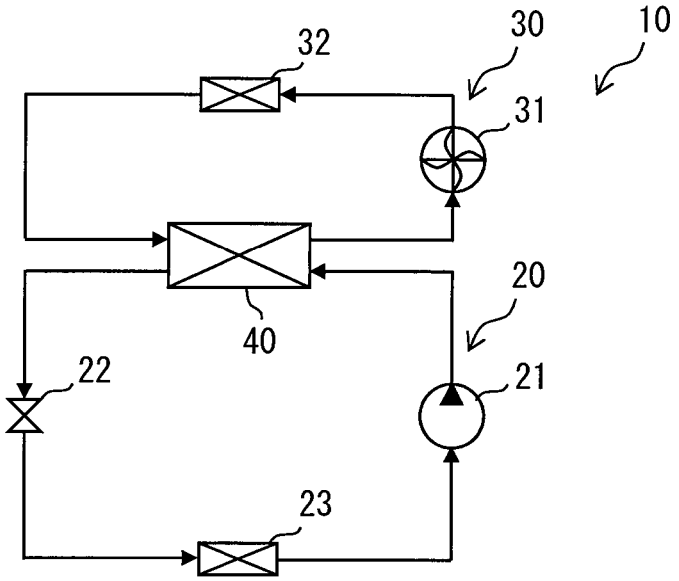
FIG. 1 is a block diagram of a thermal system according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

As illustrated in FIG. 1, a first embodiment discloses a thermal system 10. The thermal system 10 is mounted in a vehicle. The thermal system 10 provides an air conditioning system for a vehicle, or a temperature regulating device of an equipment mounted in the vehicle. When the thermal system 10 is used as the air conditioning apparatus, the thermal system 10 provides heating and/or cooling. When the thermal system 10 is used as the temperature regulating device, the thermal system 10 provides a heat source for heating and/or a low temperature source for cooling. The thermal system 10 has a refrigeration cycle 20. The refrigeration cycle 20 is a vapor compression refrigeration cycle 20 that compresses vapor of the refrigerant to provide a low temperature and a high temperature. A refrigerant is also called "first heat medium". Further, the thermal system 10 has an auxiliary system 30 in which the heat medium flows. The heat medium performs a heat exchange with the refrigerant in the refrigeration cycle 20. The auxiliary system 30 circulates a coolant that mainly contains water as the heat medium. The coolant is also called "second heat medium". The auxiliary system 30 can be also called "high temperature system" or "first auxiliary system" thermally coupled with a radiator of the refrigeration cycle 20.

The refrigeration cycle 20 includes a compressor 21, a heat exchanger 40, a decompressor 22, and a heat exchanger 23, which are arranged in a circulation refrigerant route. The compressor 21 takes in the refrigerant, compresses the taken refrigerant, and discharges the compressed refrigerant.

The heat exchanger 40 is a stacked heat exchanger for providing a heat exchange between water and the refrigerant. The heat exchanger 40 functions as a radiator. The heat exchanger 40 executes the heat radiation from the refrigerant of high temperature and high pressure, which is supplied from the compressor 21. The heat exchanger 40 performs a heat exchange with water of the auxiliary system 30. The heat exchanger 40 can be also called "stacked water-refrigerant heat exchanger for refrigeration cycle". The heat exchanger 40 can be also called "stacked water-refrigerant radiator". In heater applications or heating applications, the heat exchanger 40 provides a user side heat exchanger for heating a user side medium such as conditioning air.

The decompressor 22 decompresses a high pressure refrigerant thermally radiated in the heat exchanger 40 to provide a refrigerant of low temperature and low pressure. The heat exchanger 23 performs a heat exchange between the refrigerant of low temperature and low pressure which is supplied from the decompressor 22 and a heat source medium. The heat exchanger 23 functions as an evaporator. The heat exchanger 23 is also called "heat absorber". In cooler applications and cooling applications, the heat exchanger 23 provides the user side heat exchanger for cooling the user side medium such as conditioning air.

The auxiliary system 30 includes a pump 31 and a heat exchanger 32, which are disposed in a circulation water pathway. The pump 31 circulates water in the auxiliary system 30. The heat exchanger 32 executes heat radiation from water flowing in the auxiliary system 30. The heat exchanger 32 performs the heat exchange with air. The heat exchanger 40 is also disposed in the water pathway of the auxiliary system 30. The auxiliary system 30 supplies a coolant to the heat exchanger 40. Hence, the auxiliary system 30 provides heat transporting means disposed at a high temperature side of the refrigeration cycle 20. The heat of the refrigeration cycle 20 is radiated to the coolant through the heat exchanger 40, and further radiated from the heat exchanger 32. In the heating applications, the conditioning air or an object is heated by the heat exchanger 32.

Figure 2:
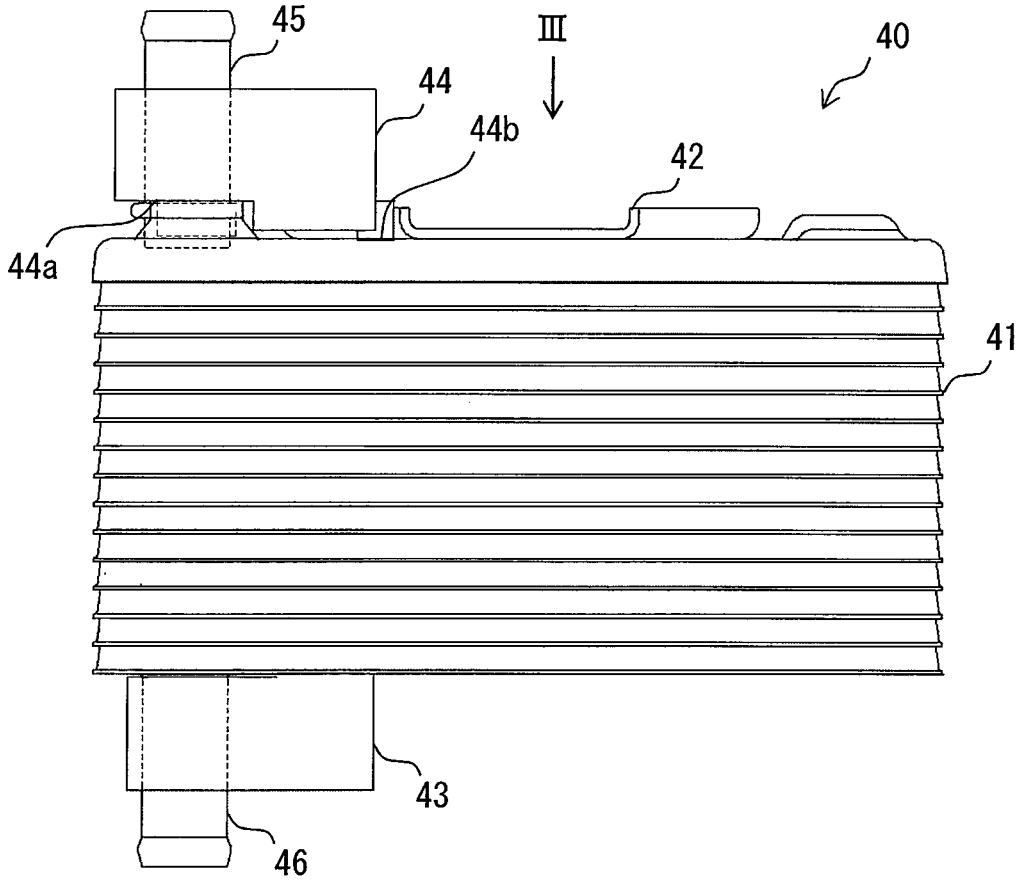
FIG. 2 is a front view of a stacked heat exchanger according to the first embodiment.

Referring to FIG. 2, the heat exchanger 40 includes a core portion 41 for heat exchange which is configured by multiple metal plates, that is, stacking plates. Refrigerant passages for refrigerant and water passages for water are partitioned between the respective adjacent plates. The core portion 41 partitions multiple passages therein. Each of the passages is a flat passage. The core portion 41 includes multiple refrigerant passages for refrigerant and multiple water passages for coolant. In the core portion 41, the refrigerant passages and the water passages are arranged alternately in a stacking direction. The water passages are also called "heat medium passages for heat medium".

The core portion 41 is substantially cuboid. A vertical direction in the figure corresponds to the stacking direction of the plates. The direction is called "stacking direction". A horizontal direction in the figure is orthogonal to the stacking direction of the core portion 41 and corresponds to a longitudinal direction of the passages defined in the core portion 41. The direction is called "transverse direction". A depth direction in the figure corresponds to a lateral direction of the passages orthogonal to the stacking direction of the core portion 41 and defined in the core portion 41. The direction is called "widthwise direction". The heat exchanger 40 can be mounted in the vehicle in a state where the stacking direction is positioned in parallel to the gravity direction as shown in the figure. The heat exchanger 40 may be mounted in the vehicle in a state where the stacking direction is positioned in parallel to the horizontal direction.

The heat exchanger 40 includes a reinforcement plate 42 joined to an end of the core portion 41. The reinforcement plate 42 is apparently thicker than other plates configuring the core portion 41. The reinforcement plate 42 is disposed to cover an area extensively spread in a planar shape on an end of the core portion 41. Further, the reinforcement plate 42 has a folded edge bent perpendicularly from a plane thereof. The folded edge enhances the rigidity of the reinforcement plate 42.

The heat exchanger 40 includes a connection member 43 for an inlet of the refrigerant. The heat exchanger 40 includes a connection member 44 for an outlet of the refrigerant. The connection members 43 and 44 are connectors called "block joints". The connection members 43 and 44 have passage holes 43*c*, 44*c* for the refrigerant, and bolt holes 43*d*, 44*d* into which bolts are screwed, respectively. The heat exchanger 40 includes a connection member 45 for an inlet of the coolant. The heat exchanger 40 includes a connection member 46 for an outlet of the coolant. The connection members 45 and 46 are tubular connectors for connection to hoses. The connection members 43 and 44 are refrigerant connection members, and correspond to a first connection member. The connection members 45 and 46 are heat medium connection members, and correspond to a second connection member.

Figure 3:
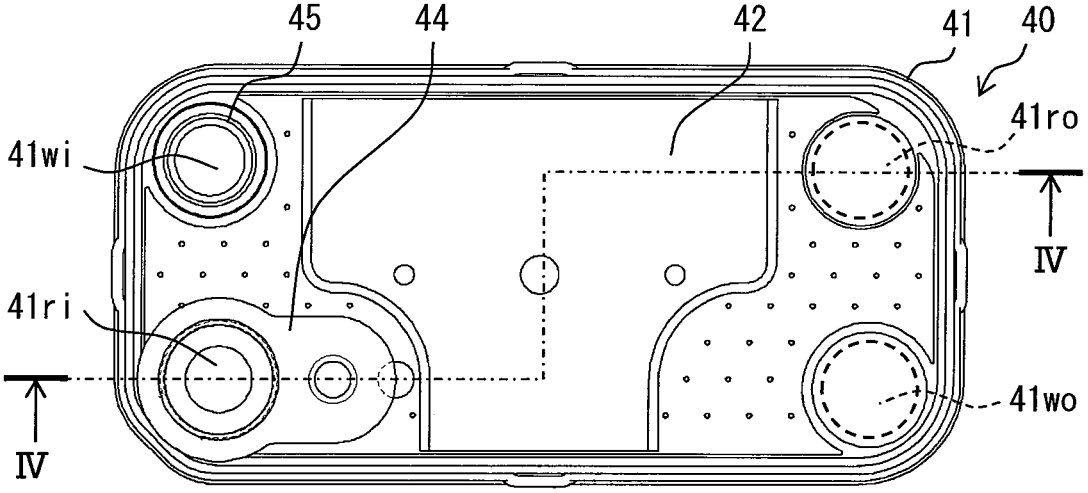
FIG. 3 is a top view of the stacked heat exchanger according to the first embodiment.

As illustrated in FIG. 3, the core portion 41 has an end surface of quadrilateral. The core portion 41 has multiple through passages 41*ri*, 41*ro*, 41*wi*, and 41*wo* extending in the stacking direction. Those through passages 41*ri*, 41*ro*, 41*wi*, and 41*wo* are arranged on corners of the core portion 41. The through passages 41*ri*, 41*ro*, 41*wi*, and 41*wo* are dispersed on the four corners of the core portion 41. The through passages 41*ri* and 41*ro* for the refrigerant are arranged on the two corners located on one diagonal of the core portion 41. The through passages 41*wi* and 41*wo* for the coolant are arranged on the two corners located on another diagonal of the core portion 41. The through passages 41*ri*, 41*ro* and the through passages 41*wi*, 41*wo* are arranged on the different diagonals.

The through passage 41*ri* in the figure communicates with the corner on one end of the flat refrigerant passages, and provides an inlet or an outlet. The through passage 41*ro* communicates with the corner of a diagonal position on the other end of the flat refrigerant passages, and provides an inlet or an outlet. The through passage 41*wi* communicates with the corner on one end of the flat water passages, and provides an inlet or an outlet. The through passage 41*wo* communicates with the corner of a diagonal position on the other end of the flat water passages, and provides an inlet or an outlet. The arrangement of those passages is effective for suppressing a death basin in the flat passage. The arrangement of those passages makes it possible to allow the refrigerant or water to flow into the overall flat passages.

Figure 4:
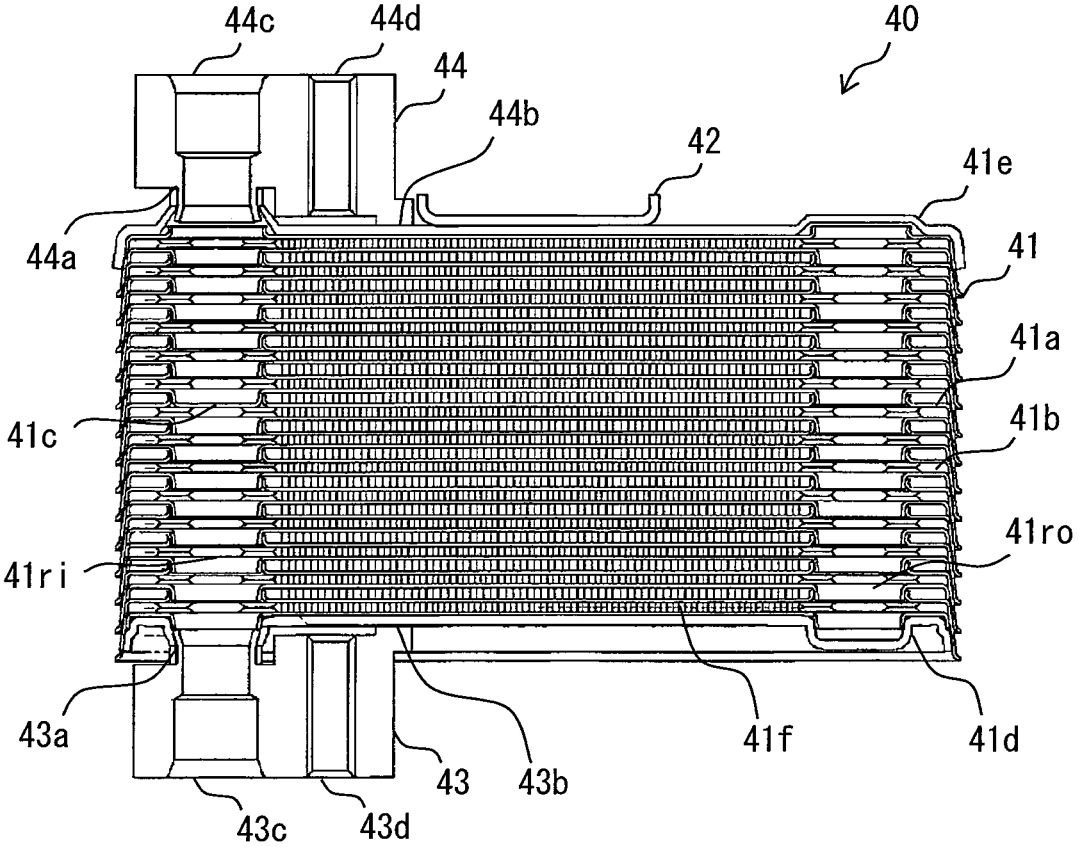
FIG. 4 is a cross-sectional view of the stacked heat exchanger according to the first embodiment.

FIG. 4 illustrates a cross-section taken along a line IV-IV indicated in FIG. 3. In the figure, hatching is omitted for clarity. As shown in the figure, the core portion 41 is configured by stacking multiple plates 41*a*, 41*b*, 41*c*, 41*d*, and 41*e*. The core portion 41 includes the core plates 41*a*, 41*b*, and 41*c* for defining the refrigerant passages and the water passages. The core portion 41 includes the end plates 41*d* and 41*e* disposed on both ends of a stacked member of the core plates 41*a*, 41*b*, and 41*c*. The end plates 41*d* and 41*e* are apparently thicker and higher in rigidity than the core plates 41*a*, 41*b*, and 41*c*. With the above configuration, a pressure resistance of the core portion 41 is improved by the end plates 41*d* and 41*e*. An offset fin 41*f* is disposed between the respective core plates 41*a*, 41*b*, and 41*c*. Those plates 41*a*, 41*b*, 41*c*, 41*d*, and 41*e*, and the fin 41*f* are made of aluminum alloy. Those plates 41*a*, 41*b*, 41*c*, 41*d*, and 41*e*, and the fin 41*f* are joined to each other by brazing.

Figure 5:
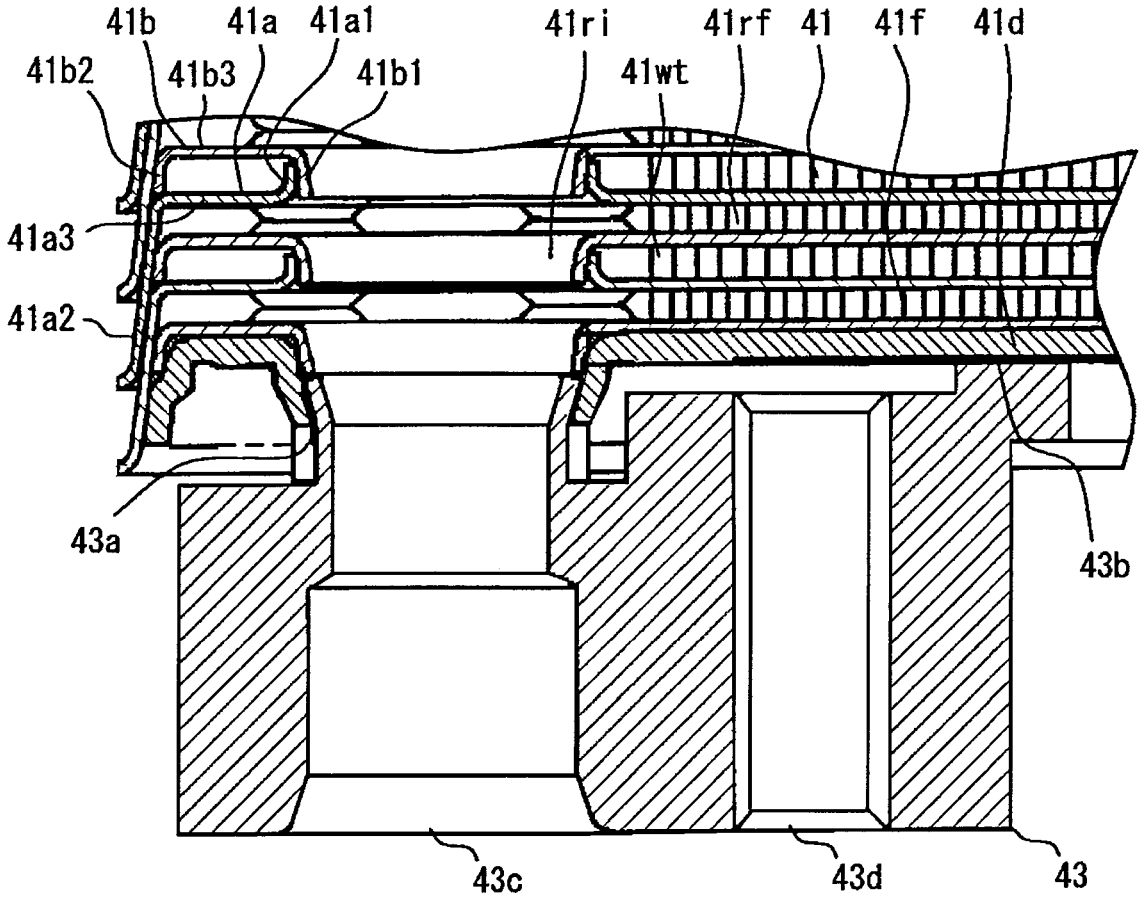
FIG. 5 is a partially enlarged cross-sectional view of the stacked heat exchanger according to the first embodiment.

FIG. 5 is a partially enlarged cross-sectional view of a neighborhood of the connection member 43. Hatching is made in the figure. A flat refrigerant passage 41*rf* or a flat water passage 41*wt* is defined between the adjacent core plates 41*a*, 41*b*, and 41*c*. The multiple core plates 41*a* and 41*b* are alternately stacked on each other to define the multiple refrigerant passages 41*rf* and the multiple water passages 41*wt*. The multiple refrigerant passages 41*rf* and the multiple water passages 41*wt* are alternately stacked on each other. A thickness of the refrigerant passages 41*rf* in the stacking direction is thinner than a thickness of the water passages 41*wt*. The fin 41*f* is disposed in both of the refrigerant passages 41*rf* and the water passages 41*wt*.

The core plates 41*a* are also called "cooling plates". Each of the core plates 41*a* has four passage cylindrical portions 41*a*1 for providing the through passages 41*ri*, 41*ro*, 41*wi*, and 41*wo*. In the figure, the passage cylindrical portion 41*a*1 for providing the through passage 41*ri* is illustrated. Each of the core plates 41*a* has an outer cylindrical portion 41*a*2 extended and exposed out of an outer peripheral surface of the core portion 41. Further, each of the core plates 41*a* has a plate portion 41*a*3 spread between those cylindrical portions.

The outer cylindrical portion 41*a*2 is inclined slightly outward so as to spread toward an opening end. The outer cylindrical portion 41*a*2 extends highly in the stacking direction. The outer cylindrical portion 41*a*2 extends to be higher than a height corresponding to two refrigerant passages 41*rf* or two water passages 41*wt*. In an example shown in the figure, the outer cylindrical portion 41*a*2 extends with a height corresponding to the two refrigerant passages 41*rf* and the two water passages 41*wt*. As a result, at least the two outer cylindrical portions 41*a*2 are located to overlap with each other on the outer peripheral surface of the core portion 41. That configuration contributes to an increase in the strength of the outer peripheral surface.

The core plates 41*b* are also called "intermediate plates". Each of the core plates 41*b* has four passage cylindrical portions 41*b*1 for providing the through passages 41*ri*, 41*ro*, 41*wi*, and 41*wo*. In the figure, the passage cylindrical portion 41*b*1 for providing the through passage 41*ri* is illustrated. Each of the core plates 41*b* has an outer cylindrical portion 41*b*2 extended along the outer cylindrical portion 41*a*2 of each core plate 41*a*. Further, the core plate 41*b* has a plate portions 41*b*3 spread between those cylindrical portions.

The passage cylindrical portions 41*a*1 and the passage cylindrical portions 41*b*1 extend in opposite directions to each other along the stacking direction. The passage cylindrical portions 41*a*1 and the passage cylindrical portions 41*b*1 are disposed to be fitted to each other inside and outside. The core plates 41*a* and 41*b* have four openings for providing the through passages 41*ri*, 41*ro*, 41*wi*, and 41*wo* in the passage cylindrical portions 41*a*1 and 41*b*1, respectively.

Each of the core plates 41*b* is not exposed to the outer peripheral surface of the core portion 41. A height of the outer cylindrical portions 41*b*2 corresponds to a thickness of the water passages 41*wt*. As a result, in the outer peripheral portion of the core portion 41, the outer cylindrical portions 41*b*2 are stacked without being inserted between the two outer cylindrical portions 41*a*2.

The core plates 41*a* and 41*b* have the outer cylindrical portions 41*a*2 and 41*b*2 positioned on an outer periphery of the core portion 41 and stacked on each other, respectively. The outer cylindrical portions 41*a*2 of the core plates 41*a* overlap with the outer cylindrical portions 41*b*2 of the core plates 41*b* with the results that one core plate 41*b* and two core plates 41*a* are located outside of the flat water passage 41*wt*. In other words, the triple core plates 41*a* and 41*b* are arranged outside of each flat water passage 41*wt*. The outer cylindrical portions 41*a*2 and 41*b*2 are at least doubly stacked on each other in the outer periphery of the core portion. The outer cylindrical portions 41*a*2 and 41*b*2 are partially triply stacked on each other in the outer periphery of the core portion 41. According to the above configuration, since the core plates are stacked on each other in the outer periphery of the core portion, the outer periphery of the core portion is reinforced. That configuration contributes to a realization of the high strength outside of the water passages 41*wt*.

Figure 6:
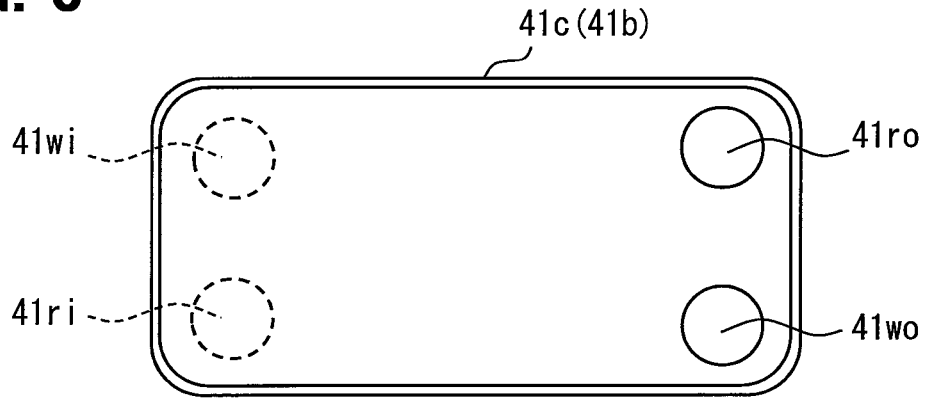
FIG. 6 is a top view of a compartment plate according to the first embodiment.

As illustrated in FIG. 6, the core plate 41*c* has openings for providing the through passages 41*ro* and 41*wo*, but does not provide openings for providing the through passages 41*ri* and 41*wi*, and closes those positions.

The core plate 41*c* is also called "partition plate 41*c*". The partition plate 41*c* divides the multiple passages 41*rf* and 41*wt* in the heat exchanger 40 into multiple groups. The partition plate 41*c* provides a flow path flowing in those groups in series. The partition plate 41*c* provides a partition plate for setting a flow route of the refrigerant and/or water within the core portion 41. Only one or several partition plates 41*c* are provided in the core portion 41. In this embodiment, the partition plate 41*c* is provided by changing a shape of the core plate 41*b*. The core plate 41*b* has the four passage cylindrical portions 41*b*1. The partition plate 41*c* also has the four passage cylindrical portions 41*b*1. However, the partition plate 41*c* closes at least one of those passage cylindrical portions without opening.

With the formation of at least one closing portion in the partition plate 41*c*, a U-turn shaped flow path is defined in the core portion 41. The U-turn shaped flow path is a flow path extending along a horizontal direction orthogonal to the stacking direction of the plates, and positioned so that the U-shape is toppled over sideways. In other words, the core portion 41 defines the U-shaped flow path that extends toward one way in the horizontal direction orthogonal to the stacking direction of the core plates, thereafter extends in the stacking direction of the core plates, and then extends toward the other way in the horizontal direction orthogonal to the stacking direction of the core plates. With the above configuration, multistage flow paths are defined in the stacking direction. The provision of the partition plate 41*c* makes it possible to set the positions of the connection members 43 and 44 on the core portion 41 and the positions of the connection members 45 and 46 on the core portion 41 to desired positions.

Returning to FIGS. 4 and 5, the connection members 43 and 44 are block-shaped members made of metal. The connection members 43 and 44 are joined to the core portion 41 in major first joints 43*a* and 44*a* around the through passage 41*ri*, respectively. The connection members 43 and 44 are mainly joined to the end plates 41*d* and 41*e*, respectively. The connection members 43 and 44 are joined to the core portion 41 by brazing.

Further, the connection members 43 and 44 have additional second joints 43*b* and 44*b* which are separated from the through passage 41*ri*, and located closer to a center of the core portion 41 than the through passage 41*ri*. The second joints 43*b* and 44*b* are formed to project toward the core portion 41 from the connection members 43 and 44 in a leg shape. A distance between an outer edge of the core portion 41 and the second joints 43*b*, 44*b* is larger than a distance between an outer edge of the core portion 41 and the through passage 41*ri*.

When the core portion 41 is deformed to expand and/or contract in the stacking direction, the second joints 43*b* and 44*b* suppress such deformations. When the core portion 41 is deformed, the second joints 43*b* and 44*b* suppress destruction in the first joints 43*a* and 44*a*, respectively.

As described above, the connection members 43 and 44 include the first joints 43*a* and 44*a* disposed around the passage 41*ri* for allowing the refrigerant or the heat medium to flow therein, and joined to the core portion 41, respectively. Further, the connection members 43 and 44 include the second joints 43*b* and 44*b* joined to the core portion 41 disposed at positions closer to the center than the first joints 43*a* and 44*a* on an end surface in the stacking direction of the core portion 41, respectively. According to the above configuration, the connection members 43 and 44 are disposed across the first joints 43*a* and 44*a*, and the second joints 43*b* and 44*b*, respectively. The connection members 43 and 44 suppress the deformation of the core portion 41 between the first joints 43*a*, 44*a*, and the second joints 43*b*, 44*b*, respectively. Hence, the pressure resistance of the core portion 41 is improved.

Figure 7:
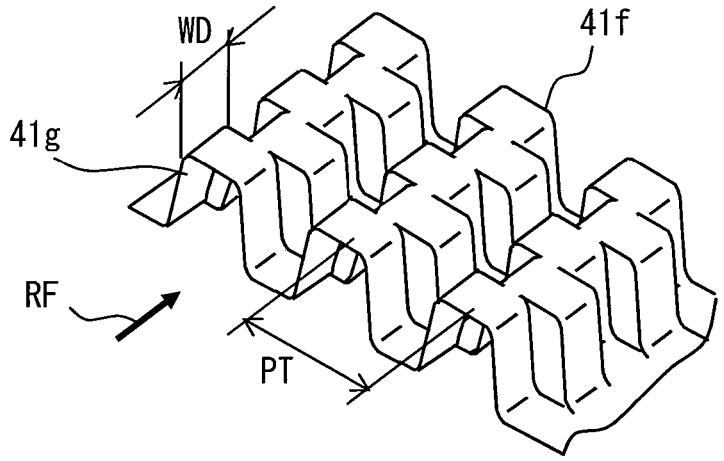
FIG. 7 is a perspective view of a fin according to the first embodiment.

As illustrated in FIG. 7, the fin 41*f* is a so-called offset fin. The fin 41*f* may be also called "divided fin". The fin 41*f* is made of aluminum alloy. The fin 41*f* is a plate molded in a wave shape. The fin 41*f* comes in heat transferable contact with the core plates 41*a* and 41*b* adjacent to apexes thereof. The fin 41*f* has a large number of slits that communicate between both surfaces thereof. Slits are spread over the overall fin 41*f* in a height direction thereof. The fin 41*f* is disposed so that a refrigerant RF flows into a direction of an arrow shown in the figure.

The fin 41*f* can be regarded as an aggregation of multiple strip portions 41*g*. Each of the strip portions 41*g* has a width WD along a flowing direction. Each of the strip portions 41*g* is molded in a trapezoidal shape having pitches PT in a direction orthogonal to the flowing direction. Two of the strip portions 41*g* adjacent to each other in the flowing direction are displaced from each other in the direction orthogonal to the flowing direction by ¼ pitches (¼ PT).

The fin 41*f* provides a large number of tip portions in the refrigerant passages 41*rf* and the water passages 41*wt*. Those tip portions improve the heat exchanging performance.

The large number of large slits provided in the fin 41*f* facilitates flow down of a refrigerant liquid component from a plate surface of the fin 41*f*. For that reason, the liquid component is likely to spread over the overall refrigerant passages 41*rf*. As a result, the deviation of the liquid refrigerant in the refrigerant passages 41*rf* is suppressed.

With the facilitation of the flow down of the refrigerant liquid component, a thickness of a liquid film on the plate surface of the fin 41*f* is maintained thinly. This effectively causes a phase change in the refrigerant on the plate surface of the fin 41*f*. In a process of condensing the refrigerant, the condensation of the refrigerant is facilitated. On the other hand, in a process of evaporating the refrigerant, the evaporation of the liquid refrigerant is facilitated.

Figure 8:
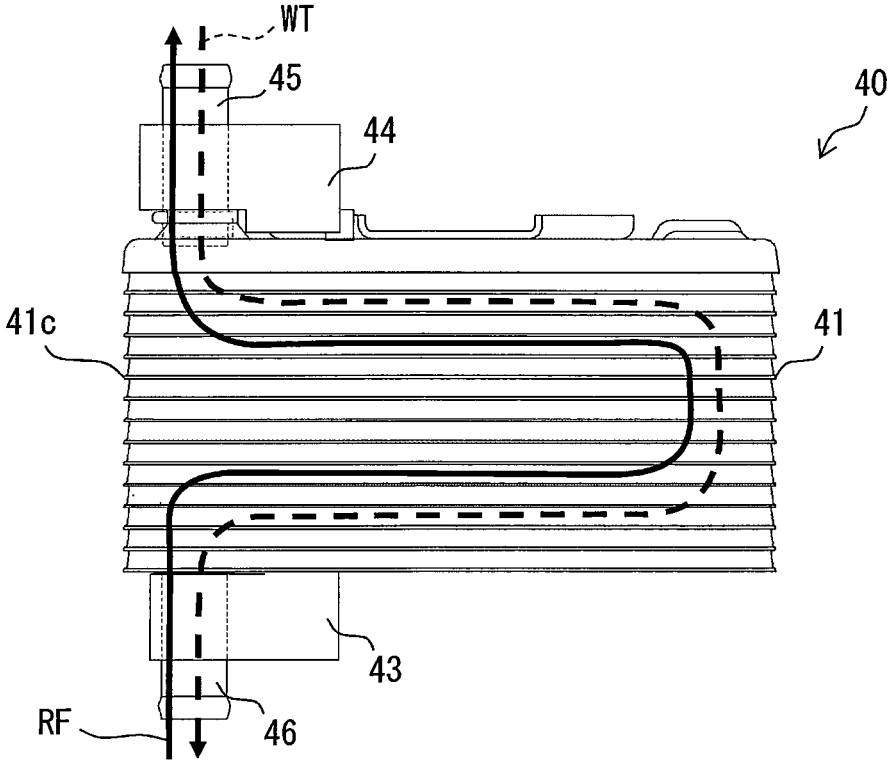
FIG. 8 is a front view illustrating a flow path of the stacked heat exchanger according to the first embodiment.

As illustrated in FIG. 8, the refrigerant RF flows in the heat exchanger 40 as indicated by a solid arrow. A water WT flows in the heat exchanger 40 as indicated by a dashed arrow. The refrigerant and the water flow in the heat exchanger 40 in counter flows. Hence, an excellent heat exchange is realized between the refrigerant and the water.

The partition plate 41*c* divides the multiple passages 41*rf* for the refrigerant in the heat exchanger 40 into two groups. The partition plate 41*c* has a closing portion that is not opened in one of the through passages 41*ri* and 41*ro*. The above division is provided by the closing portion. Further, in the partition plate 41*c*, those two groups of refrigerant passages 41*rf* are arranged in series between an inlet and an outlet of the refrigerant, that is, between the connection members 43 and 44. The partition plate 41*c* has an opening in the other of the through passages 41*ri* and 41*ro*. The above series arrangement is provided by the opening. As a result, the two groups of refrigerant passages 41*rf* provide a series flow path.

The partition plate 41*c* divides the multiple passages 41*wt* for the water in the heat exchanger 40 into two groups. The partition plate 41*c* has a closing portion that is not opened in one of the through passages 41*wi* and 41*wo*. The above division is provided by the closing portion. Further, in the partition plate 41*c*, those two groups of passages 41*wt* are arranged in series between an inlet and an outlet of the water, that is, between the connection members 45 and 46. The partition plate 41*c* has an opening in the other of the through passages 41*wi* and 41*wo*. The above series arrangement is provided by the opening. As a result, the two groups of passages 41*wt* provide a series flow path.

In an example shown in the figure, two groups are positioned on an upper portion and a lower portion of the heat exchanger 40. The connection members 43, 44, and the connection members 45, 46 are used as inlets and outlets, respectively, so that the refrigerant and the water flow in the core portion 41 in opposite directions. In other words, the inlets and the outlets are allocated, and configured to the connection members 43, 44, 45, and 46 so that the heat medium flowing in the heat medium passages 41*wt* flows in the opposite direction to that of the refrigerant flowing in the refrigerant passages 41*rf*. As a result, the counter flows are obtained for one group. Further, the counter flows are obtained for the other group. According to the above configuration, the counter flows of the refrigerant and the water are produced over a long distance.

In this embodiment, the core plates 41*a*, 41*b*, and 41*c* include the partition plate 41*c* that divides the refrigerant passages 41*rf* and/or the heat medium passages 41*wt* in the core portion 41 into multiple groups, and communicates with those groups in series. The partition plate 41*c* has closing portions for closing the through passages 41*ri*, 41*ro*, 41*wi*, and 41*wo* extending from the connection members 43, 44, 45, and 46. The core plates 41*a* and 41*b* other than the partition plate 41*c* have openings for providing all of the through passages 41*ri*, 41*ro*, 41*wi*, and 41*wo* extending from the connection members 43, 44, 45, and 46, respectively.

According to this embodiment, the connection members 43, 44, and the connection members 45, 46 can be dispersively arranged on both end surfaces of the core portion 41. The connection members 43, 44, and the connection members 45, 46 can be concentrated on one side of the core portion 41 in the horizontal direction, that is, on a left side in the figure. The arrangement of the inlets and the outlets for the refrigerant and the water makes it possible to arrange a refrigerant piping and a water piping linearly. Hence, the arrangement contributes to an improvement in mountability of the core portion 41 in the vehicle. The above arrangement also contributes to an improvement in connection work of the piping.

When the thermal system 10 operates, the refrigeration cycle 20 supplies the refrigerant of the high temperature and high pressure to the heat exchanger 40. The auxiliary system 30 supplies water to the heat exchanger 40. The refrigerant and the water perform the heat exchange within the core portion 41. The refrigerant is cooled and condensed by the water. Further, the refrigerant is subcooled by the water. This makes it possible to enhance the efficiency of the refrigeration cycle 20.

Second Embodiment

This embodiment is a modification with the preceding embodiment as a basic configuration. In the above embodiment, the counter flows are produced in the overall core portion 41. Instead, in this embodiment, the counter flows are produced in a part of the core portion 41.

Figure 9:
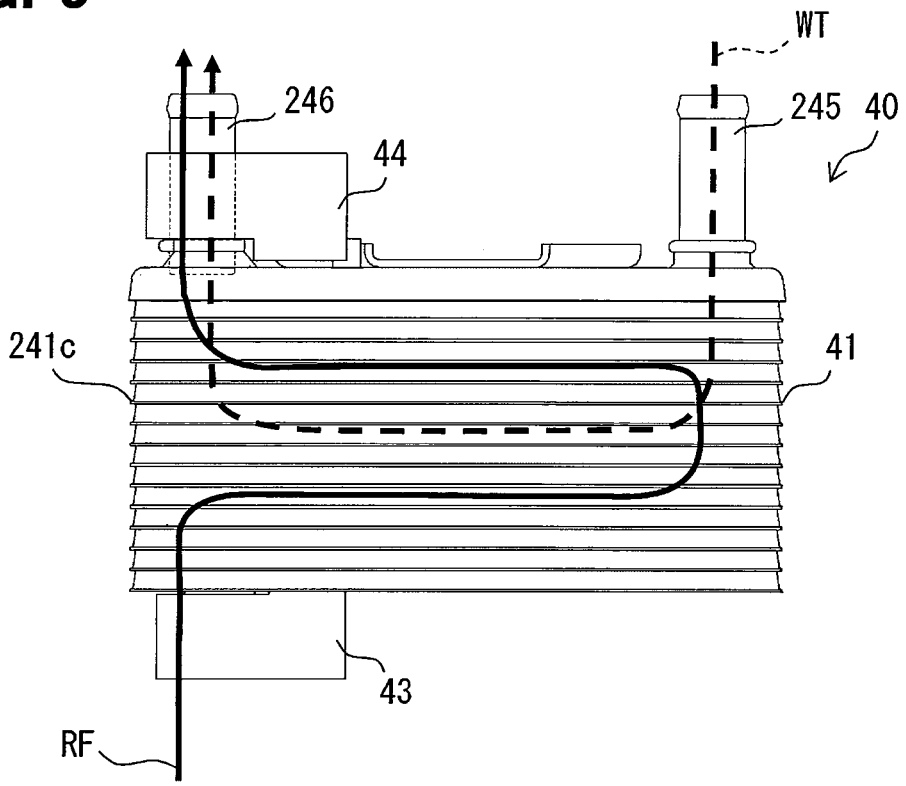
FIG. 9 is a front view of a stacked heat exchanger according to a second embodiment.

As illustrated in FIG. 9, a heat exchanger 40 has a connection member 245 which is an inlet of water, and a connection member 246 which is an outlet of the water on one end surface thereof. The connection member 245 and the connection member 246 are arranged on corners located diagonally on an upper end surface in the figure. Those connection members 245 and 246 extend in parallel. Connection members 43 and 44 are dispersively arranged on both of the end surfaces of a core portion 41. The connection members 43 and 44 are intensively arranged in one side in the horizontal direction. Further, in this embodiment, a partition plate 241*c* is used.

Figure 10:
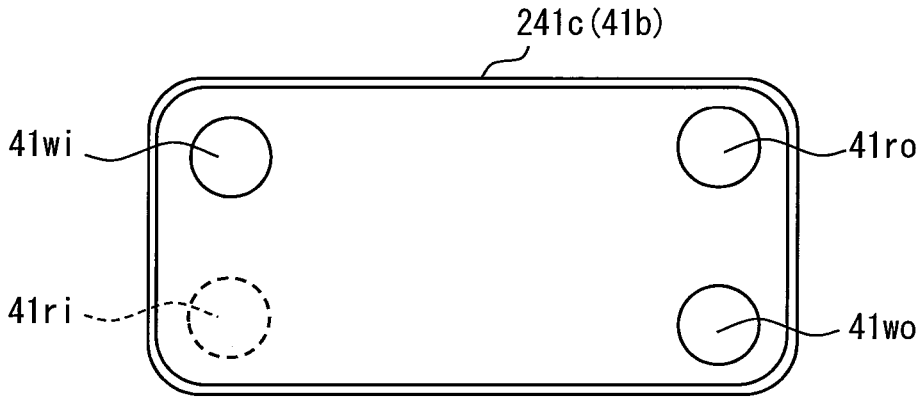
FIG. 10 is a top view of a compartment plate according to the second embodiment.

As illustrated in FIG. 10, the partition plate 241*c* has a closing portion in a through passage 41*ri*. The partition plate 241*c* has openings in through passages 41*ro*, 41*wi*, and 41*wo*. As a result, the partition plate 241*c* divides only multiple passages 41*rf* for refrigerant into two groups. The partition plate 241*c* does not divide multiple passages 41*rwt* for water.

In this embodiment, a U-turn shaped flow path along a horizontal direction for refrigerant is defined in the core portion 41. All of the passages 41*wt* defined in the core portion 41 are connected in parallel to each other between the connection members 245 and 246. Since the connection members 245 and 246 are intensively arranged on one of the end surfaces, a U-shaped flow path for water along the stacking direction is defined in the core portion 41. According to the above configuration, a length of the flow path for the refrigerant can be lengthened. The refrigerant and the water can flow in the opposite directions in about half of the flow path for the refrigerant.

Third Embodiment

This embodiment is a modification with the preceding embodiment as a basic configuration. In the above embodiments, the partition plates 41*c* and 241*c* are used. In this embodiment, no partition plate is used.

Figure 11:
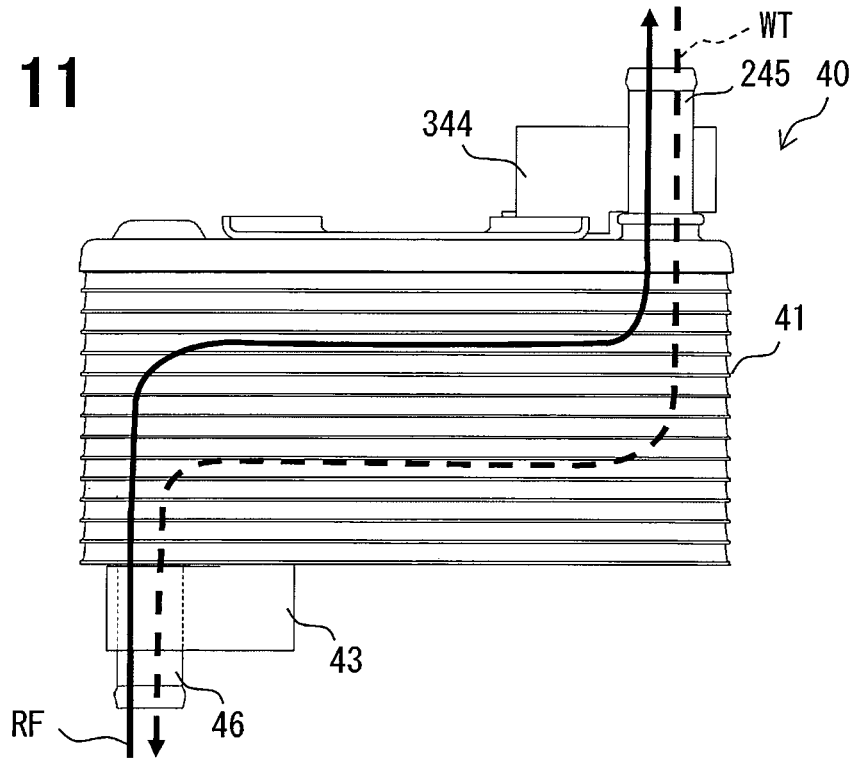
FIG. 11 is a front view of a stacked heat exchanger according to a third embodiment.

As illustrated in FIG. 11, a heat exchanger 40 has a connection member 43 and a connection member 46 on one end surface. Further, the heat exchanger 40 has a connection member 245 and a connection member 344 as an outlet of refrigerant, on the other end surface. In this embodiment, no partition plate is used. For that reason, all of multiple passages 41*rf* defined in a core portion 41 are connected in parallel to each other between the connection members 43 and 344. Since the connection members 43 and 344 are dispersively arranged on both surfaces, an S-shaped flow path for refrigerant is defined in the core portion 41. All of the multiple passages 41*wt* defined in the core portion 41 are connected in parallel to each other between the connection members 245 and 46. Since the connection members 245 and 46 are dispersively arranged on both surfaces, an S-shaped flow path for water is defined in the core portion 41. Similarly, in the above embodiment, the counter flows are provided in the overall core portion 41.

Fourth Embodiment

Figure 12:
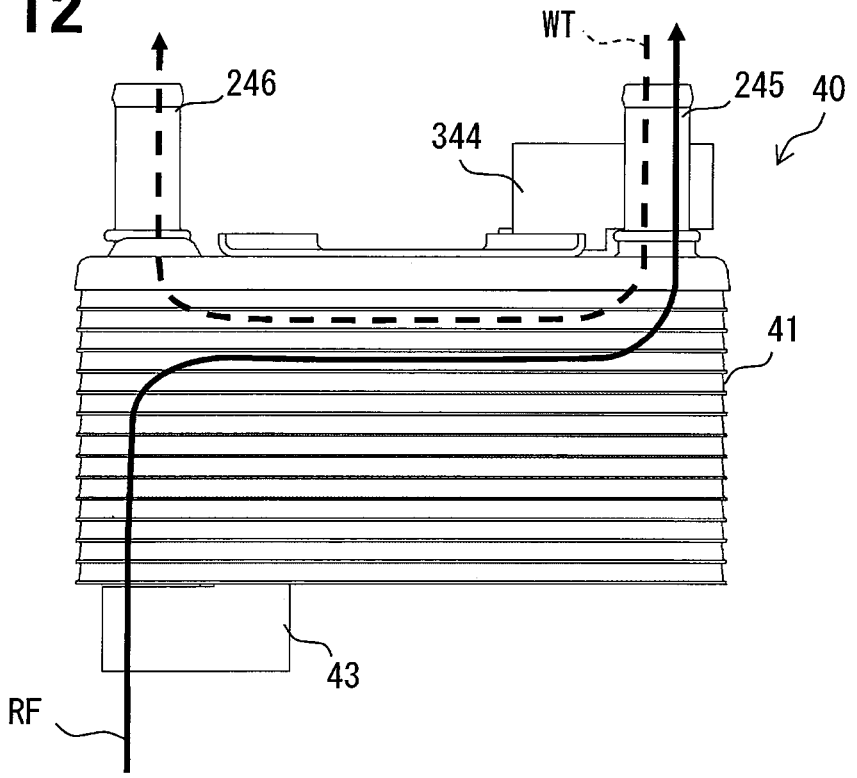
FIG. 12 is a front view of a stacked heat exchanger according to a fourth embodiment.

This embodiment is a modification with the preceding embodiment as a basic configuration. As illustrated in FIG. 12, a heat exchanger 40 has a connection member 43 on one end surface. Further, the heat exchanger 40 has connection members 245, 246 and a connection member 344 on the other end surface. In this embodiment, no partition plate is used. For that reason, all of multiple passages 41*rf* defined in a core portion 41 are connected in parallel to each other between the connection members 43 and 344. Since the connection members 43 and 344 are dispersively arranged on both surfaces, an S-shaped flow path for refrigerant is defined in the core portion 41. Similarly, in the above embodiment, the counter flows are provided in the overall core portion 41.

Fifth Embodiment

Figure 13:
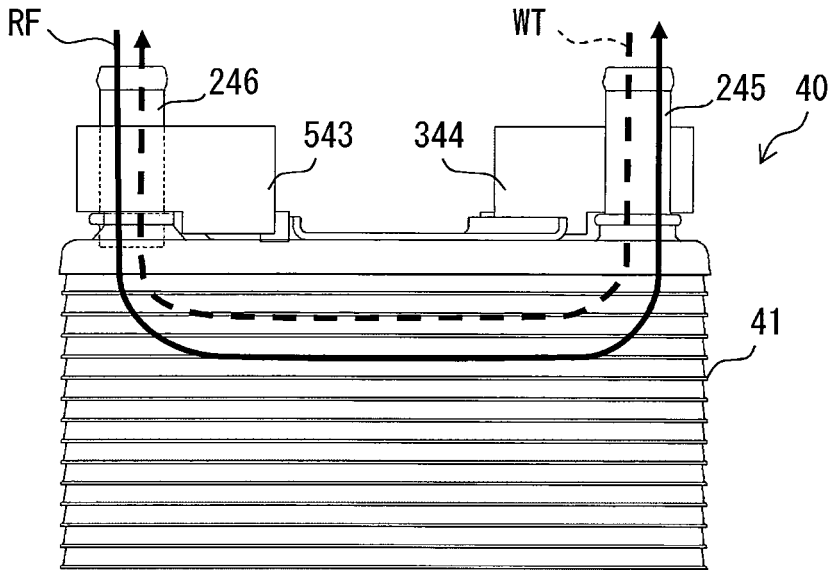
FIG. 13 is a front view of a stacked heat exchanger according to a fifth embodiment.

This embodiment is a modification with the preceding embodiment as a basic configuration. As illustrated in FIG. 13, a heat exchanger 40 has connection members 245, 246 and a connection member 344 on one end surface. Further, the heat exchanger 40 includes a connection member 543 for an inlet of the refrigerant on the same end surface. In this embodiment, no partition plate is used. For that reason, all of multiple passages 41*rf* defined in a core portion 41 are connected in parallel to each other between the connection members 543 and 344. Since the connection members 543 and 344 are intensively arranged on one of the end surfaces, a U-shaped flow path for refrigerant along the stacking direction is defined in the core portion 41. Similarly, in the above embodiment, the counter flows are provided in the overall core portion 41.

Sixth Embodiment

This embodiment is a modification with the preceding embodiment as a basic configuration. In the above embodiments, the core plates 41*a* and 41*b* are triply stacked on each other at a position corresponding to the water passage in the outer periphery of the core portion 41. In this embodiment, the core plates 41*a* and 41*b* are triply stacked on each other at a position corresponding to the refrigerant passage.

Figure 14:
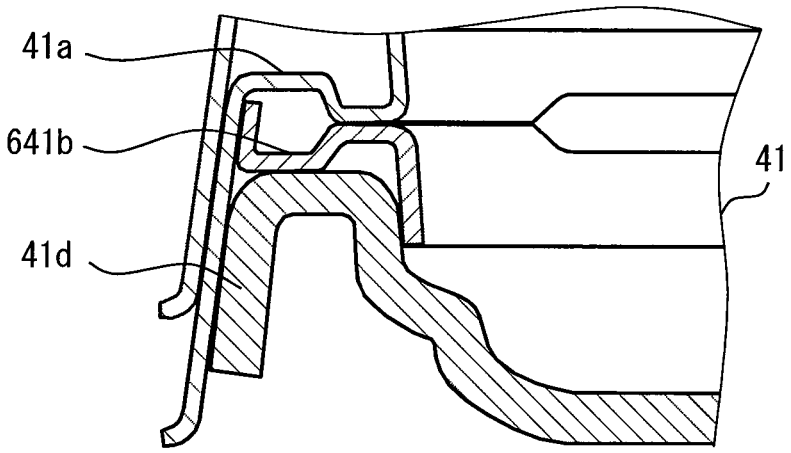
FIG. 14 is a partially enlarged cross-sectional view of a stacked heat exchanger according to a sixth embodiment.

As illustrated in FIG. 14, a core plate 641*b* is bent to be stacked on another core plate 41*a* outside of a passage for refrigerant. With the above configuration, the rigidity of the core portion 41 outside of a refrigerant passage can be enhanced.

Seventh Embodiment

This embodiment is a modification with the preceding embodiment as a basic configuration. In the above embodiments, the heat exchanger 40 is cooled by only the auxiliary system 30. Instead, in this embodiment, a heat exchanger 740 which is cooled by multiple auxiliary systems 30 and 50 is employed.

Figure 15:
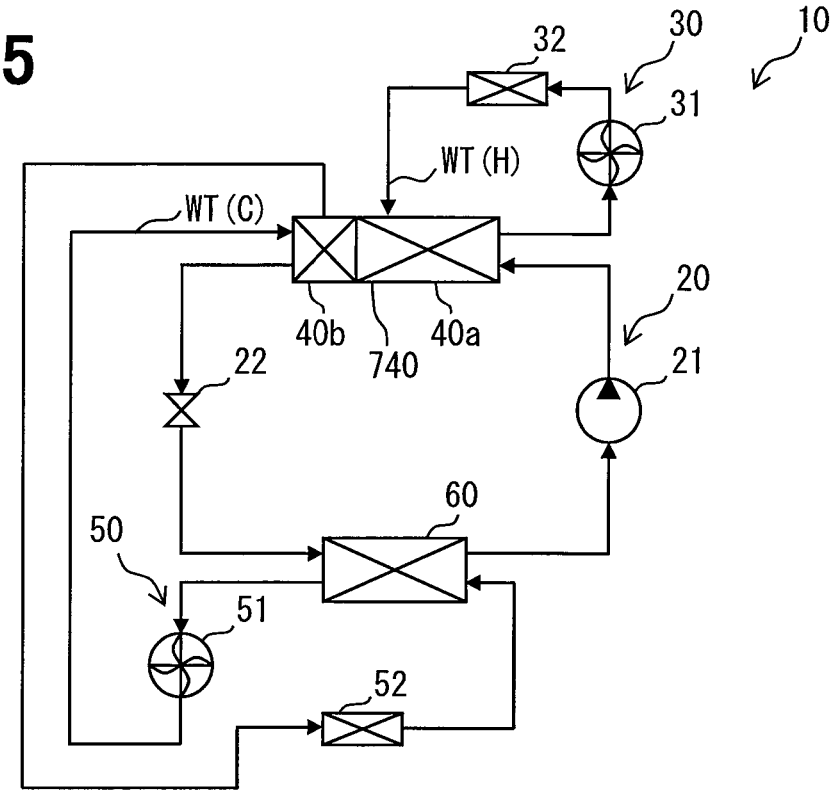
FIG. 15 is a block diagram of a thermal system according to a seventh embodiment.

As illustrated in FIG. 15, the thermal system 10 has an auxiliary system 50 in which the heat medium flows. The heat medium performs a heat exchange with the refrigerant in the refrigeration cycle 20. The auxiliary system 50 circulates a coolant that mainly contains water as the heat medium. The coolant is also called "third heat medium". The auxiliary system 50 can be also called "low temperature system" or "second auxiliary system" thermally coupled with an evaporator of the refrigeration cycle 20.

The refrigeration cycle 20 has a heat exchanger 740. The heat exchanger 740 is a stacked heat exchanger for providing a heat exchange between water and the refrigerant. The heat exchanger 740 functions as a radiator. The heat exchanger 740 has heat exchanging units 40*a* and 40*b* of multiple stages which radiate heat from refrigerant in a stepwise fashion.

A previous stage 40*a* is disposed on an upstream side of a subsequent stage 40*b* in a refrigerant flow. The previous stage 40*a* cools the refrigerant of high temperature and high pressure, which is supplied from a compressor 21. Water is supplied to the previous stage 40*a* from the auxiliary system 30. The previous stage 40*a* provides a heat exchange between the refrigerant and water in the auxiliary system 30.

The subsequent stage 40*b* is disposed on a downstream side of the previous stage 40*a* in the refrigerant flow. The subsequent stage 40*b* further cools the refrigerant cooled in the previous stage 40*a*. Water is supplied to the subsequent stage 40*b* from the auxiliary system 50. The subsequent stage 40*b* provides a heat exchange between the refrigerant and water in the auxiliary system 50.

The refrigeration cycle 20 has a heat exchanger 60. The heat exchanger 60 is a stacked heat exchanger for providing a heat exchange between water and the refrigerant. The heat exchanger 60 functions as an evaporator. The heat exchanger 60 has the same structure as that of the heat exchanger 40 in the above embodiments. The stacked heat exchanger disclosed in the present specification can be used as not only a radiator but also an evaporator. The heat exchanger 60 is configured by stacking multiple plates corresponding to the core plates 41*a*, 41*b*, and 41*c*. The heat exchanger 60 has refrigerant passages corresponding to the refrigerant passages 41*rf* and water passages corresponding to the water passages 41*wt*.

The heat exchanger 60 executes a heat absorption on the refrigerant of low temperature and low pressure which is supplied from the decompressor 22. The heat exchanger 60 performs a heat exchange with water of the auxiliary system 50. The heat exchanger 60 can be also called "stacked water-refrigerant heat exchanger for refrigeration cycle". The heat exchanger 60 can be also called "stacked water-refrigerant evaporator". In cooler applications and cooling applications, the heat exchanger 60 provides the user side heat exchanger for cooling the user side medium such as conditioning air.

The auxiliary system 50 includes a pump 51 and a heat exchanger 52, which are disposed in a circulation water pathway. The pump 51 circulates water in the auxiliary system 50. The heat exchanger 52 executes heat absorption on water flowing in the auxiliary system 50. The heat exchanger 52 performs the heat exchange with air. The auxiliary system 50 has a piping configured to supply water to the subsequent stage 40*b* of the heat exchanger 740. The heat exchanger 60 is also disposed in the water pathway of the auxiliary system 50. The auxiliary system 50 supplies a coolant to the heat exchanger 60. Hence, the auxiliary system 50 provides heat transporting means disposed at a low temperature side of the refrigeration cycle 20. The refrigeration cycle 20 absorbs heat from the coolant through the heat exchanger 60. In the cooling applications, the conditioning air or an object is heated by the heat exchanger 52.

In the above configuration, the water in the auxiliary system 50 is cooled by the refrigeration cycle 20. As a result, a temperature of the water in the auxiliary system 50 is lower than a temperature of the water in the auxiliary system 30. Hence, a water WT (H) of a relatively high temperature is supplied to the previous stage 40*a*. A water WT (C) of a relatively low temperature is supplied to the subsequent stage 40*b*. The previous stage 40*a* functions as a condenser for condensing the refrigerant. The subsequent stage 40*b* functions as a subcooler for further subcooling the condensed refrigerant. As a result, the heat exchanger 40 supplies a subcooling refrigerant to the decompressor 22.

Figure 16:
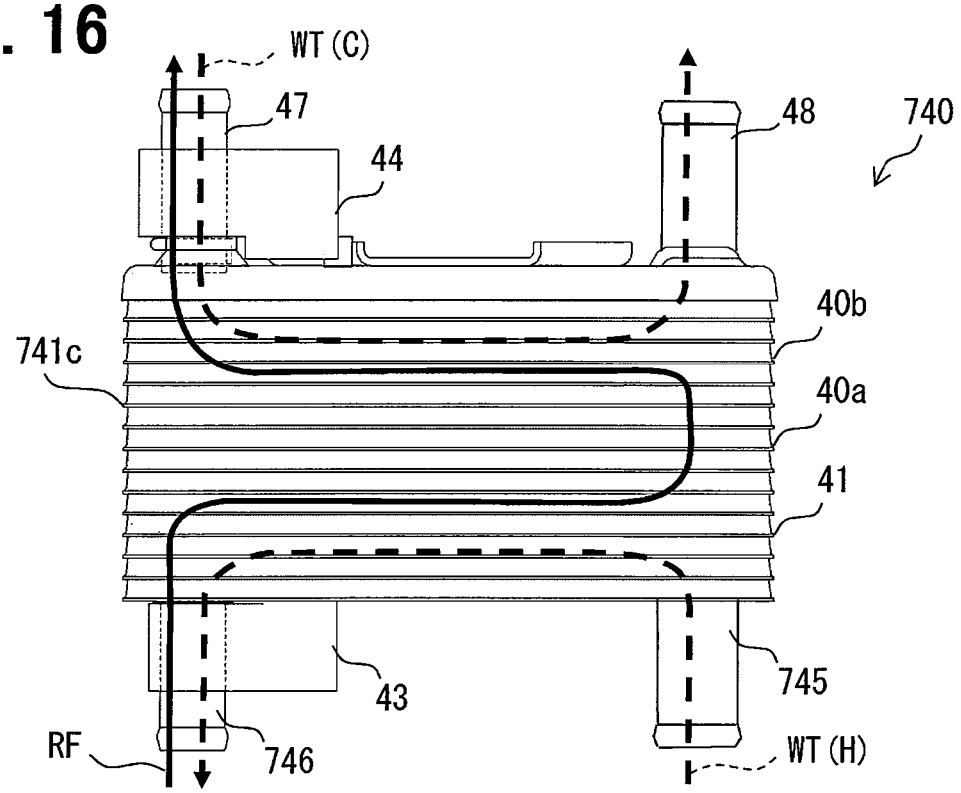
FIG. 16 is a front view illustrating a flow path of a stacked heat exchanger according to the seventh embodiment.

As illustrated in FIG. 16, the heat exchanger 740 includes connection members 43 and 44 for an inlet and an outlet of the refrigerant. Further, the heat exchanger 740 includes connection members 745 and 746 for an inlet and an outlet of water to be connected to the auxiliary system 30. The connection members 745 and 746 are arranged on one end surface of the core portion 41. The heat exchanger 740 includes connection members 47 and 48 for an inlet and an outlet of water to be connected to the auxiliary system 50. The connection members 47 and 48 are arranged on the other end surface of the core portion 41.

Figure 17:
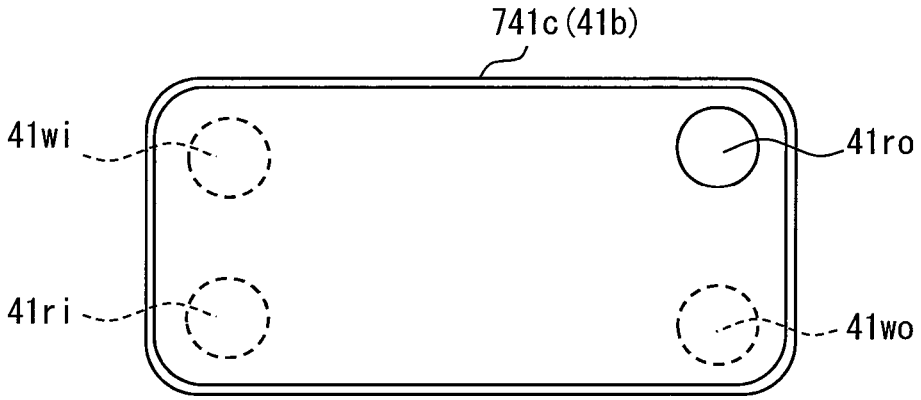
FIG. 17 is a top view of a compartment plate according to the seventh embodiment.

As illustrated in FIG. 17, the partition plate 741*c* has closing portions in through passages 41*ri*, 41*wi*, and 41*wo*. The partition plate 741*c* has an opening in a through passage 41*ro*. As a result, the partition plate 741*c* divides multiple passages 41*rf* for refrigerant into two groups. Further, the partition plate 741*c* arranges two groups of passages 41*rf* in series. On the other hand, the partition plate 741*c* completely divides the multiple passages 41*wt* for water into two groups, and does not communicate those groups with each other. As a result, the previous stage 40*a* and the subsequent stage 40*b* are partitioned in the core portion 41, and provided, separately.

In this embodiment, a U-turn shaped flow path along a horizontal direction for refrigerant is defined in the core portion 41. The multiple passages 41*wt* belonging to one of the groups are connected in parallel to each other between the connection members 745 and 746. Since the connection members 745 and 746 are intensively arranged on one of the end surfaces, a U-shaped flow path for water WT(H) along the stacking direction is defined in the core portion 41. The multiple passages 41*wt* belonging to the other group are connected in parallel to each other between the connection members 47 and 48. Since the connection members 47 and 48 are intensively arranged on one of the end surfaces, a U-shaped flow path for water WT(C) along the stacking direction is defined in the core portion 41. According to the above configuration, a length of the flow path for the refrigerant can be lengthened. The refrigerant and the water can flow in the opposite directions in the overall flow path for the refrigerant.

Eighth Embodiment

This embodiment is a modification with the preceding embodiment as a basic configuration. In the above embodiments, the water WT(C) of the second auxiliary system 50 is supplied to the subsequent stage 40*b*. Instead, in this embodiment, a previous stage 60*a* and a subsequent stage 60*b* are also disposed in the heat exchanger 60. Further, in this embodiment, a third auxiliary system 70 that provides a heat exchange between the subsequent stage 40*b* and the subsequent stage 60*b* is employed.

Figure 18:
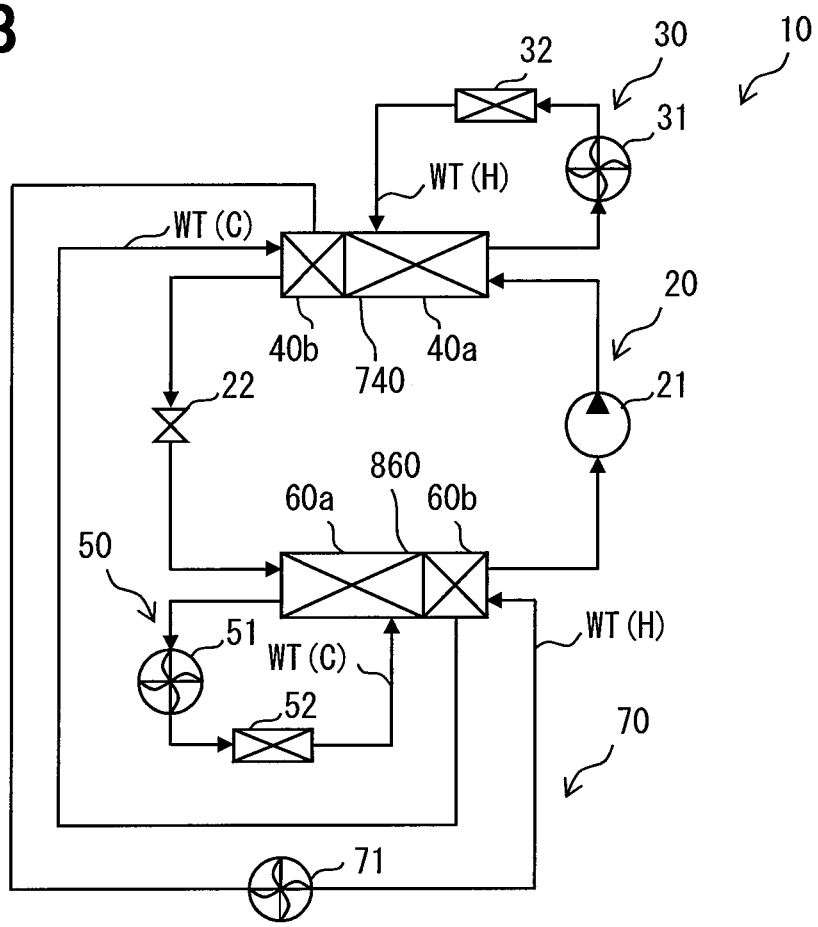
FIG. 18 is a block diagram of a thermal system according to an eighth embodiment.

As illustrated in FIG. 18, the thermal system 10 includes a heat exchanger 740. Further, the thermal system 10 includes a heat exchanger 860. The heat exchanger 860 has the same structure as that of the heat exchanger 740. The heat exchanger 860 has heat exchanging units 60*a* and 60*b* of multiple stages, which allow the refrigerant to absorb heat in a stepwise fashion.

The previous stage 60*a* is disposed on an upstream side of the subsequent stage 60*b* in a refrigerant flow. The previous stage 60*a* heats the refrigerant of low temperature and low pressure, which is supplied from a decompressor 22, to thereby allow the refrigerant to absorb the heat. Water is supplied to the previous stage 60*a* from the auxiliary system 50. The previous stage 60*a* provides a heat exchange between the refrigerant and water in the auxiliary system 50.

The subsequent stage 60*b* is disposed on a downstream side of the previous stage 60*a* in the refrigerant flow. The subsequent stage 60*b* allows the refrigerant that has absorbed the heat in the previous stage 60*a* to further absorb heat. Water is supplied to the subsequent stage 60*b* from the auxiliary system 70. The subsequent stage 60*b* provides a heat exchange between the refrigerant and water in the auxiliary system 70.

The auxiliary system 70 thermally couples between the subsequent stage 40*b* and the subsequent stage 60*b*. The auxiliary system 70 includes a pump 71 in a route in which water circulates. The subsequent stage 40*b* and the subsequent stage 60*b* are arranged in the auxiliary system 70. Hence, the auxiliary system 70 allows the water to flow so as to circulate between the subsequent stage 40*b* and the subsequent stage 60*b*.

Figure 19:
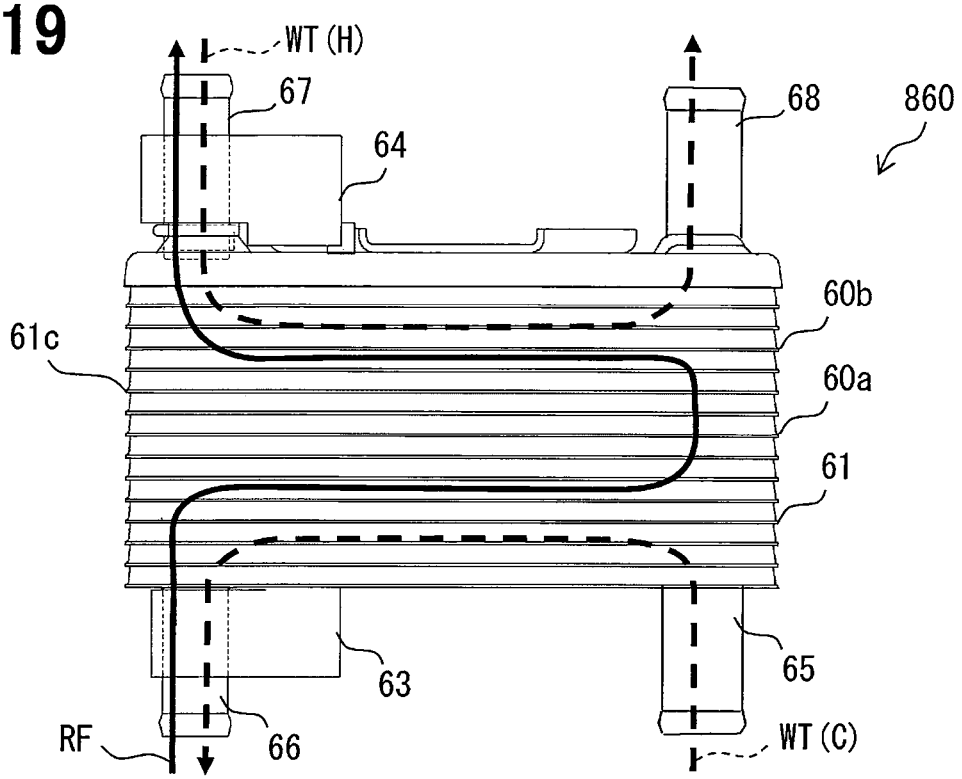
FIG. 19 is a front view illustrating a flow path of a stacked heat exchanger according to the eighth embodiment.

As illustrated in FIG. 19, the heat exchanger 860 includes the same components as those of the heat exchanger 740. The heat exchanger 860 has a core portion 61. The core portion 61 has the same structure as that of the core portion 41 described above. The core portion 61 is partitioned into the previous stage 60*a* and the subsequent stage 60*b* by a partition plate 61*c*. The partition plate 61*c* has the same shape as that of the partition plate 741*c*. The heat exchanger 860 includes connection members 63 and 64 for an inlet and an outlet of the refrigerant. The heat exchanger 860 includes connection members 65 and 66 for an inlet and an outlet of water to be connected to the auxiliary system 50. The connection members 65 and 66 are arranged on one end surface of the core portion 61. The heat exchanger 860 includes connection members 67 and 68 for an inlet and an outlet of water to be connected to the auxiliary system 70. The connection members 67 and 68 are arranged on the other end surface of the core portion 61.

According to this embodiment, the water in the auxiliary system 70 is cooled by the refrigerant of low temperature and low pressure in the subsequent stage 60*b*. The water in the auxiliary system 70 is supplied to the subsequent stage 40*b*. As a result, the water in the auxiliary system 70 cools the refrigerant on a high pressure side of the refrigeration cycle 20. In a desired operating state, the refrigerant to be supplied to the decompressor 22 is subcooled. The water in the auxiliary system 70 is heated in the subsequent stage 40*b*. The water in the auxiliary system 70 is supplied to the subsequent stage 60*b*. As a result, the water in the auxiliary system 70 heats the refrigerant on a low pressure side of the refrigeration cycle 20. In the desired operating state, the refrigerant drawn into the compressor 21 is superheated. As described above, an internal heat exchange of the refrigeration cycle 20 is provided through the auxiliary system 70.

Ninth Embodiment

This embodiment is a modification with the preceding embodiment as a basic configuration. In the above embodiments, the internal heat exchange of the refrigeration cycle 20 is provided through the water in the auxiliary system 70, that is, a heat medium different from the refrigerant. Instead, in this embodiment, a direct internal heat exchange is provided with the use of the refrigerant in the refrigeration cycle 20.

Figure 20:
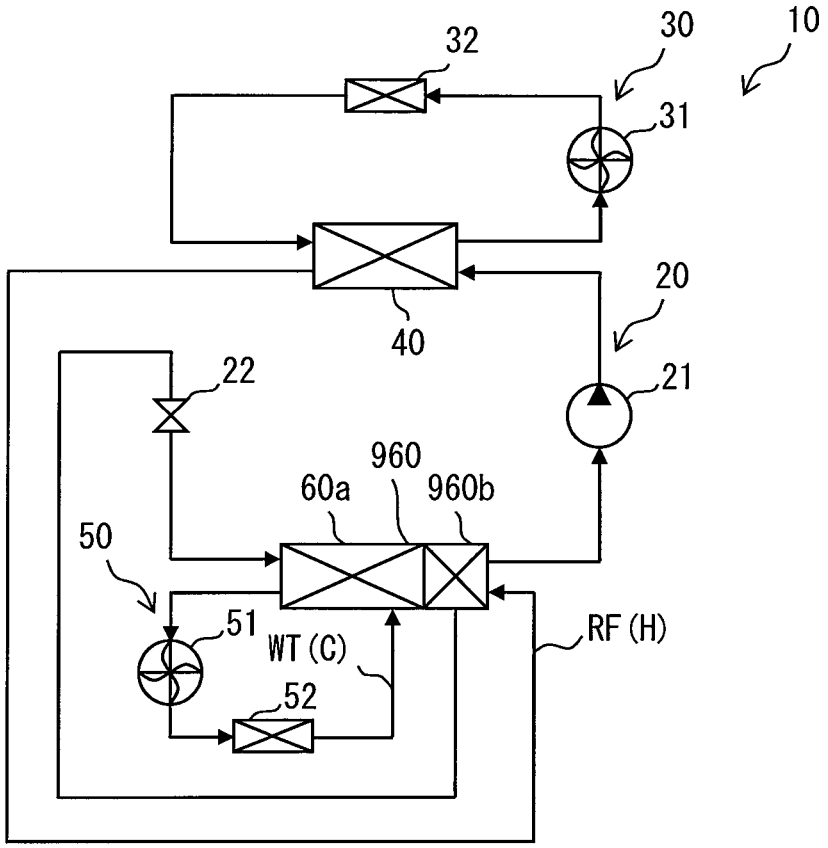
FIG. 20 is a block diagram of a thermal system according to a ninth embodiment.

As illustrated in FIG. 20, a heat exchanger 960 has a previous stage 60*a* and a subsequent stage 960*b*. The subsequent stage 960*b* provides a heat exchange between a refrigerant of low temperature and low pressure, which has passed through the previous stage 60*a*, and a refrigerant RF (H) of high temperature and high pressure, which has passed through a heat exchanger 40.

Figure 21:
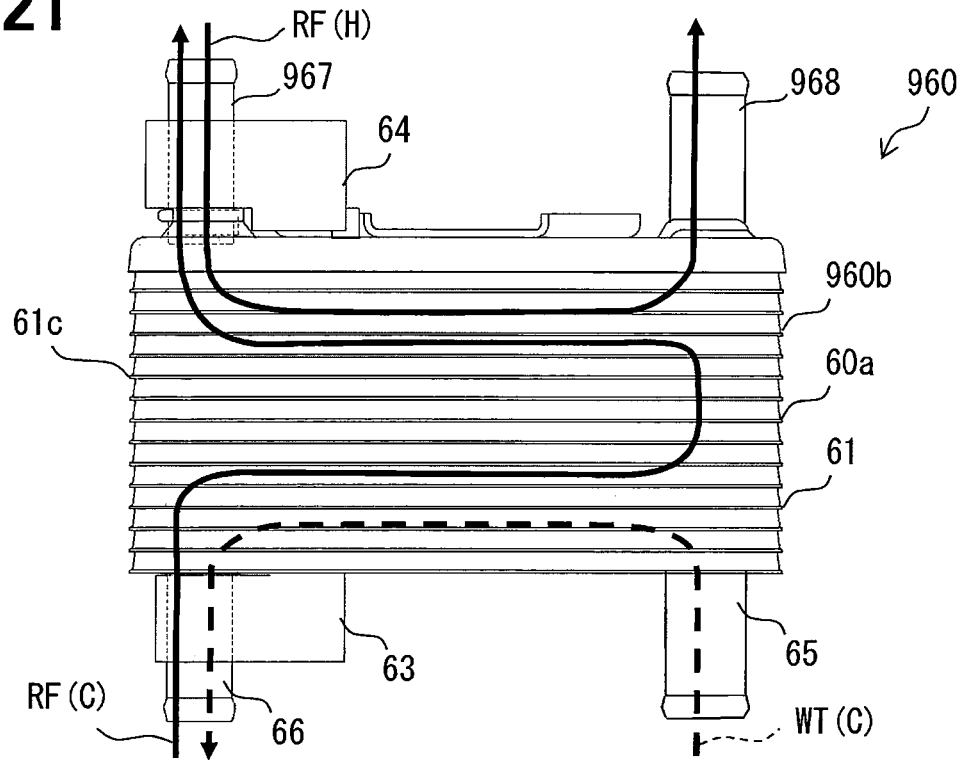
FIG. 21 is a front view illustrating a flow path of a stacked heat exchanger according to the ninth embodiment.

As illustrated in FIG. 21, the heat exchanger 960 includes the same components as those of the heat exchanger 860. The heat exchanger 960 includes connection members 967 and 968 for an inlet and an outlet of the refrigerant RF(H) of high temperature and high pressure. In this embodiment, a subsequent stage 960*b* that provides an internal heat exchange between the high-temperature high-pressure refrigerant RF (H) and the low-temperature low-pressure refrigerant RF (C) can be provided in a part of the heat exchanger 960 configured as the water-refrigerant heat exchanger.

Tenth Embodiment

This embodiment is a modification with the preceding embodiment as a basic configuration. In the above embodiments, the internal heat exchanger is integrated with the heat exchanger 960. Instead, in this embodiment, an internal heat exchanger is integrated with a heat exchanger 1040.

Figure 22:
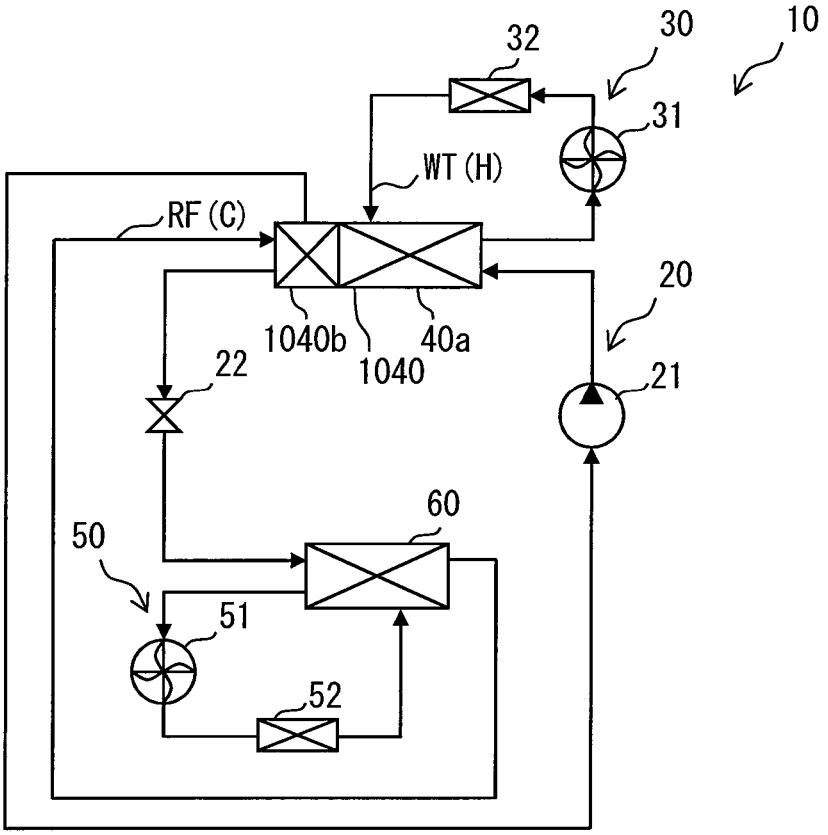
FIG. 22 is a block diagram of a thermal system according to a tenth embodiment.

As illustrated in FIG. 22, the heat exchanger 1040 includes a previous stage 40*a* and a subsequent stage 1040*b*. The subsequent stage 1040*b* provides a heat exchange between a refrigerant that has passed through the previous stage 40*a* and a refrigerant RF (C) that has passed through a heat exchanger 60. In this embodiment, a subsequent stage 1040*b* that provides an internal heat exchange between the high-temperature high-pressure refrigerant RF (H) and the low-temperature low-pressure refrigerant RF (C) can be provided in a part of the heat exchanger 1040 configured as the water-refrigerant heat exchanger.

In the seventh embodiment to the tenth embodiment, core portions 41 and 61 include the previous stages 40*a* and 60*a* that provide the heat exchange between the refrigerant and the first heat medium with the use of the heat medium as the first heat medium, respectively. Further, the core portions 41 and 61 include subsequent stages 40*b*, 60*b*, 960*b*, and 1040*b* that provide the heat exchange between the refrigerant that has performed the heat exchange in the previous stage 40*a* and the second heat medium having a temperature different from that of the first heat medium. As a result, the heat exchange of two stages is provided.

When the refrigerant to be supplied to the previous stage and the subsequent stage is a refrigerant on a high pressure side of the refrigeration cycle 20, the second heat medium can be set as a heat medium WT(C) that has performed a heat exchange with the refrigerant on a low pressure side of the refrigeration cycle 20. When the refrigerant to be supplied to the previous stage and the subsequent stage is a refrigerant on a low pressure side of the refrigeration cycle 20, the second heat medium can be set as a heat medium WT(H) that has performed a heat exchange with the refrigerant on a high pressure side of the refrigeration cycle 20. When the refrigerant to be supplied to the previous stage and the subsequent stage is a refrigerant on a low pressure side of the refrigeration cycle 20, the second heat medium can be set as a refrigerant RF(H) on a high pressure side of the refrigeration cycle. When the refrigerant to be supplied to the previous stage and the subsequent stage is a refrigerant on a high pressure side of the refrigeration cycle 20, the second heat medium can be set as a refrigerant RF(C) on a low pressure side of the refrigeration cycle.

Eleventh Embodiment

This embodiment is a modification with the preceding embodiment as a basic configuration. In the above embodiments, the heat exchanger 40 and the heat exchanger 60 are arranged at positions distant from each other as separate components. Instead, in this embodiment, a core portion of a heat exchanger 80 disposed as a single component includes a heat exchange portion 1140 on a high pressure side to which a refrigerant on the high pressure side of the refrigeration cycle 20 is supplied, and a heat exchange portion 1160 on a low pressure side to which a refrigerant on the low pressure side of the refrigeration cycle 20 is supplied.

Figure 23:
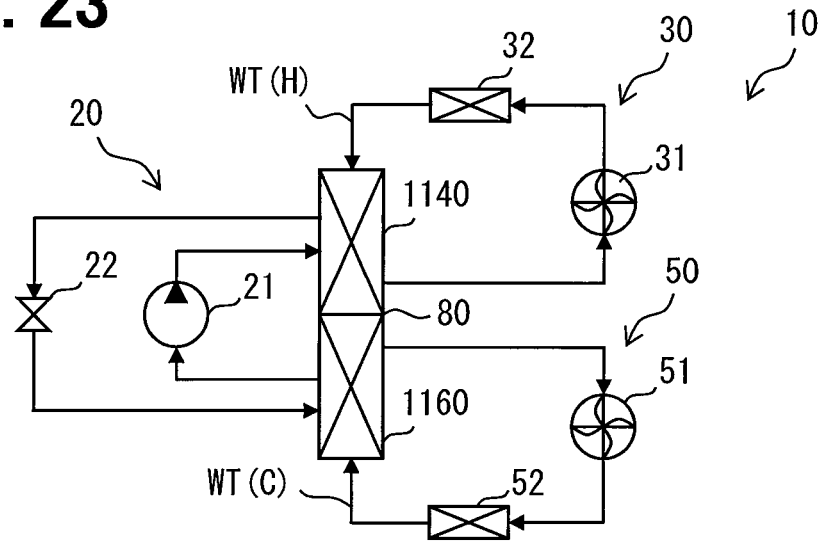
FIG. 23 is a block diagram of a thermal system according to an eleventh embodiment.

As illustrated in FIG. 23, the refrigeration cycle 20 is equipped with a composite-type heat exchanger 80 having the heat exchange portion 1140 and the heat exchange portion 1160. The heat exchanger 80 is a stacked heat exchanger. The heat exchange portion 1140 is provided by one half of the heat exchanger 80. The heat exchange portion 1160 is provided by the remaining half of the heat exchanger 80. The heat exchange portion 1140 and the heat exchange portion 1160 are partitioned through a boundary plate configuring the stacked heat exchanger. The boundary plate provides a heat transfer portion that performs an internal heat exchange between the high pressure side and the low pressure side of the refrigeration cycle 20.

Figure 24:
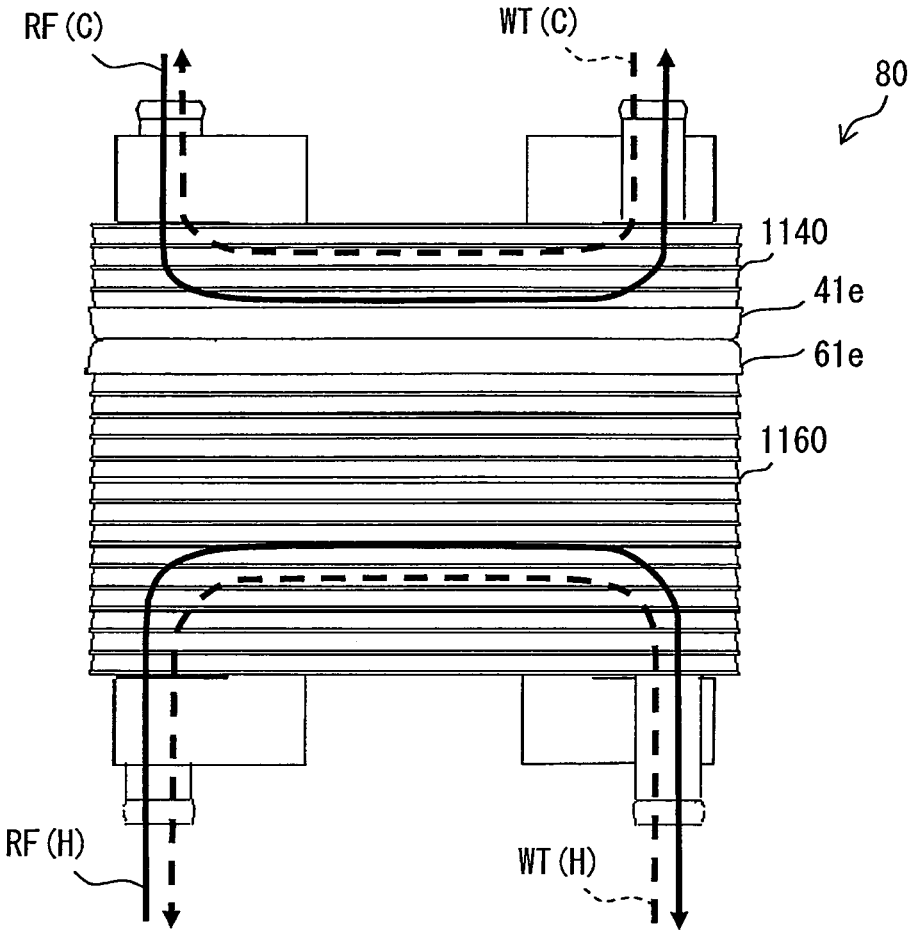
FIG. 24 is a front view illustrating a flow path of a stacked heat exchanger according to the eleventh embodiment.

As illustrated in FIG. 24, the heat exchanger 80 is formed by joining the stacked heat exchanger providing the heat exchange portion 1140 directly to the stacked heat exchanger providing the heat exchange portion 1160. An end plate 41*e* disposed on an end of the heat exchange portion 1140 and an end plate 61*e* disposed on an end of the heat exchange portion 1160 are disposed back to back, and brazed. The end plates 41*e* and 61*e* provide the boundary plate. This makes it possible to perform a direct heat conduction between the heat exchange portion 1140 and the heat exchange portion 1160. The heat conduction provides the internal heat exchange.

Twelfth Embodiment

Figure 25:
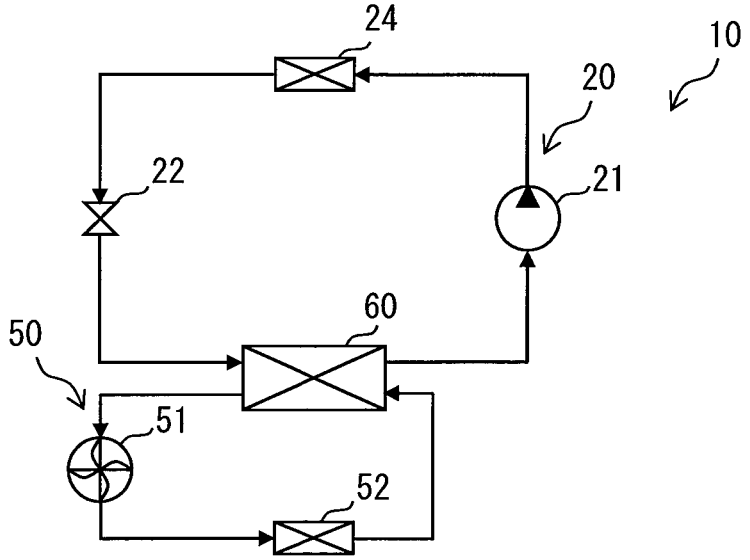
FIG. 25 is a block diagram of a thermal system according to a twelfth embodiment.

This embodiment is a modification with the preceding embodiment as a basic configuration. In this embodiment, a refrigeration cycle 20 illustrated in FIG. 25 is employed. The refrigeration cycle 20 employs a stacked heat exchanger that is a water-refrigerant heat exchanger for only a heat exchanger on a low pressure side, that is, a heat exchanger 60. The refrigeration cycle 20 includes an air-cooled heat exchanger 24. The heat exchanger 24 functions as a radiator. As described above, the water-refrigerant heat exchanger may be employed for only the heat exchanger on the low pressure side.

Thirteenth Embodiment

Figure 26:
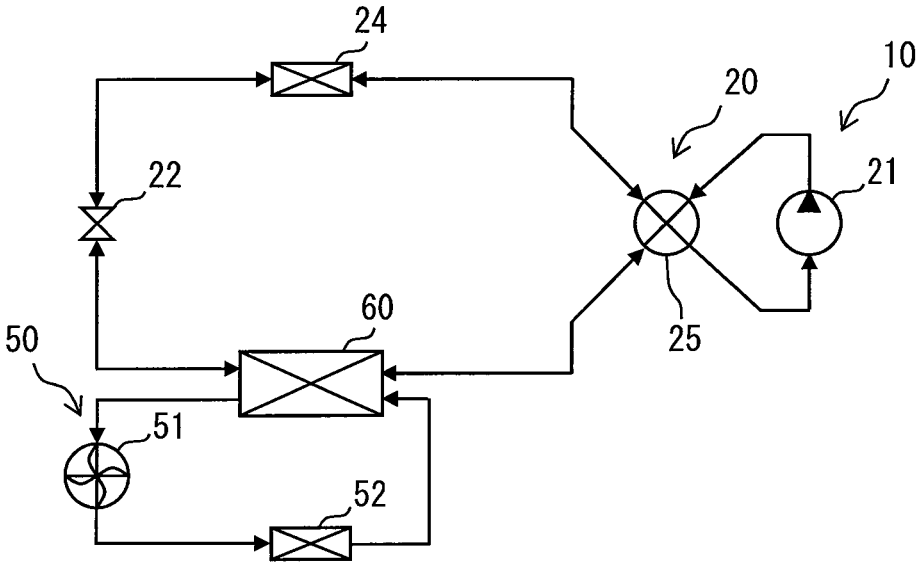
FIG. 26 is a block diagram of a thermal system according to a thirteenth embodiment.

This embodiment is a modification with the preceding embodiment as a basic configuration. In this embodiment, a refrigeration cycle 20 illustrated in FIG. 26 is employed. The refrigeration cycle 20 is a reversible refrigeration cycle. The refrigeration cycle 20 includes a switching valve 25 for switching a circulating direction of refrigerant. Hence, the refrigeration cycle 20 can selectively execute cooling operation for cooling and heating operation (heat pump operation) for heating.

When a high-temperature high-pressure refrigerant compressed by a compressor 21 is supplied to a heat exchanger 24, a heat exchanger 60 functions as an evaporator. On the other hand, when the high-temperature high-pressure refrigerant compressed by the compressor 21 is supplied to the heat exchanger 60, the heat exchanger 60 functions as a radiator.

In the above configuration, the refrigerant on a high pressure side of the refrigeration cycle 20 and the refrigerant on a low pressure side of the refrigeration cycle 20 are selectively supplied to the refrigerant passages. Hence, the heat exchanger 60 can selectively function as the radiator or the evaporator. As a result, water in an auxiliary system 50 can be cooled or heated by the refrigeration cycle 20.

Fourteenth Embodiment

Figure 27:
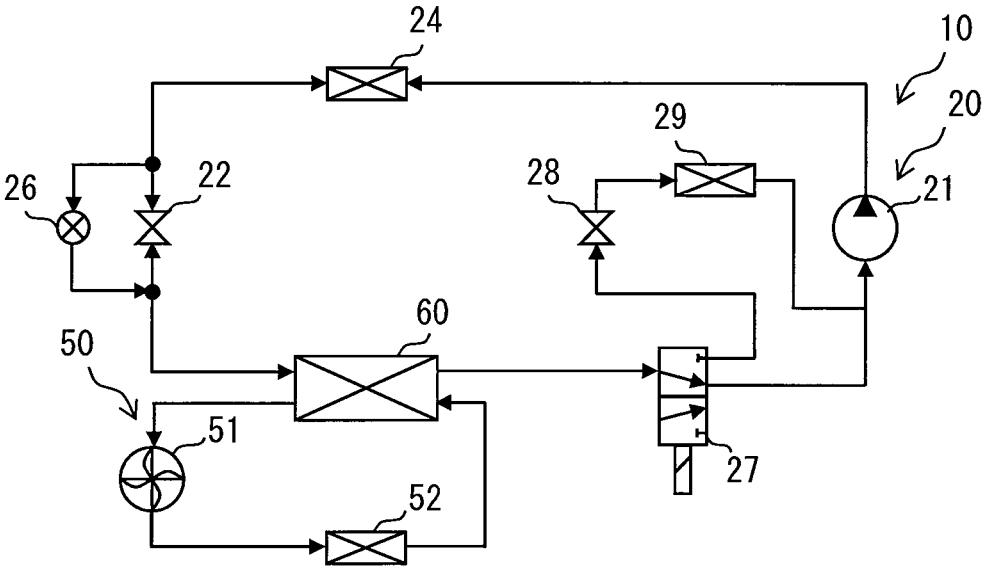
FIG. 27 is a block diagram of a thermal system according to a fourteenth embodiment.

This embodiment is a modification with the preceding embodiment as a basic configuration. In this embodiment, a refrigeration cycle 20 illustrated in FIG. 27 is employed. The refrigeration cycle 20 is a bypass refrigeration cycle in which a heat exchanger 60 is selectively located on a high pressure side or a low pressure side in the refrigeration cycle 20. The refrigeration cycle 20 can selectively execute cooling operation for cooling and heating operation (heat pump operation) for heating.

The refrigeration cycle 20 includes an opening-and-closing valve 26 that can bypass the decompressor 22. When the opening-and-closing valve 26 is opened, the decompressor 22 does not exert a decompression function. As a result, the refrigerant of high temperature and high pressure is supplied to the heat exchanger 60. A bypass passage having a switching valve 27, a decompressor 28, and a heat exchanger 29 is disposed between the heat exchanger 60 and a compressor 21. When the opening-and-closing valve 26 is opened, the switching valve 27 switches so that the refrigerant flows in the bypass passage. As a result, the heat exchanger 29 functions as an evaporator.

Similarly, in the above configuration, the refrigerant on a high pressure side of the refrigeration cycle 20 and the refrigerant on a low pressure side of the refrigeration cycle 20 are selectively supplied to the refrigerant passages. Hence, the heat exchanger 60 can selectively function as the radiator or the evaporator. As a result, water in an auxiliary system 50 can be cooled or heated by the refrigeration cycle 20. In the above configuration, a flowing direction of the refrigerant and a flowing direction of the water in the heat exchanger 60 do not change. For that reason, even if the heat exchanger 60 functions as any one of the radiator and the evaporator, the counter flow can be obtained.

Fifteenth Embodiment

Figure 28:
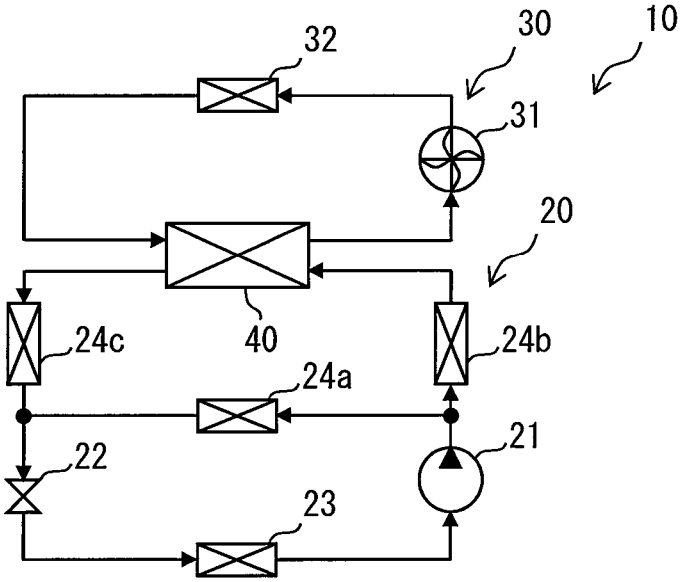
FIG. 28 is a block diagram of a thermal system according to a fifteenth embodiment.

This embodiment is a modification with the preceding embodiment as a basic configuration. In the above embodiments, only a heat exchanger 40 is disposed in a high pressure portion of a refrigeration cycle 20. In addition, another heat exchanger may be additionally provided in the high pressure portion. FIG. 28 exemplifies additional heat exchangers 24*a*, 24*b*, and 24*c*. At least one of those heat exchangers can be employed. The heat exchanger 24*a* is disposed in parallel to the heat exchanger 40 in a flow of refrigerant. The heat exchanger 24*b* is disposed in series on an upstream side of the heat exchanger 40 in the flow of refrigerant. The heat exchanger 24*c* is disposed in series on a downstream side of the heat exchanger 40 in the flow of refrigerant.

Sixteenth Embodiment

Figure 29:
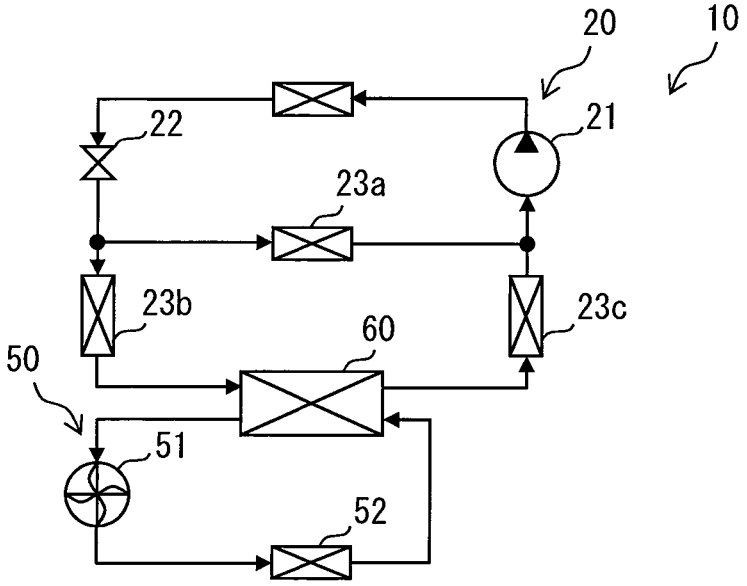
FIG. 29 is a block diagram of a thermal system according to a sixteenth embodiment.

This embodiment is a modification with the preceding embodiment as a basic configuration. In the above embodiments, only the heat exchanger 60 is disposed in the low pressure portion of the refrigeration cycle 20. In addition, another heat exchanger may be additionally provided in the low pressure portion. FIG. 29 exemplifies additional heat exchangers 23*a*, 23*b*, and 23*c*. At least one of those heat exchangers can be employed. The heat exchanger 23*a* is disposed in parallel to the heat exchanger 60 in a flow of refrigerant. The heat exchanger 23*b* is disposed in series on an upstream side of the heat exchanger 60 in the flow of refrigerant. The heat exchanger 23*c* is disposed in series on a downstream side of the heat exchanger 60 in the flow of refrigerant.

Seventeenth Embodiment

A seventeenth embodiment will be described with reference to FIGS. 30 to 36. A heat exchanger 2010 illustrated in FIGS. 30 and 31 configures a refrigeration cycle of an air conditioning apparatus for a vehicle. The heat exchanger 2010 is a condenser that performs a heat exchange between a high pressure side refrigerant of a refrigeration cycle and a coolant (heat medium) to condense the high pressure side refrigerant, or an evaporator that performs the heat exchange between a low pressure side refrigerant of the refrigeration cycle and the coolant (heat medium) to evaporate the low pressure side refrigerant.

The coolant can be, for example, a liquid containing at least ethylene glycol, dimethylpolysiloxane or nanofluidic, or antifreeze material. In this embodiment, the coolant is made of ethylene glycol-based antifreeze (LLC).

The heat exchanger 2010 is formed integrally by stacking a large number of plate members 2011 on each other, and joining the plate members 2011 to each other. In the following description, the stacking direction (vertical direction in an example of FIG. 30) of the plate members 2011 is called "plate stacking direction", one end side (upper end side in the example of FIG. 30) in the plate stacking direction is called "one end side in the plate stacking direction", and the other end side (lower end side in the example of FIG. 30) in the plate stacking direction is called "other end side in the plate stacking direction".

The plate members 2011 are formed of a substantially rectangular slender plate member, and, for example, a two-sided clad material obtained by cladding a brazing material on both surfaces of an aluminum core is used as a specific material.

Protruding portions 2111 that protrude in a substantially plate stacking direction (in other words, a direction substantially orthogonal to the plate surfaces of the plate members 2011) are formed on respective outer peripheral edges of the substantially rectangular plate members 2011. The large number of plate members 2011 are joined to each other by brazing the respective protruding portions 2111 together in a state where the plate members 2011 are stacked on each other.

Figure 30:
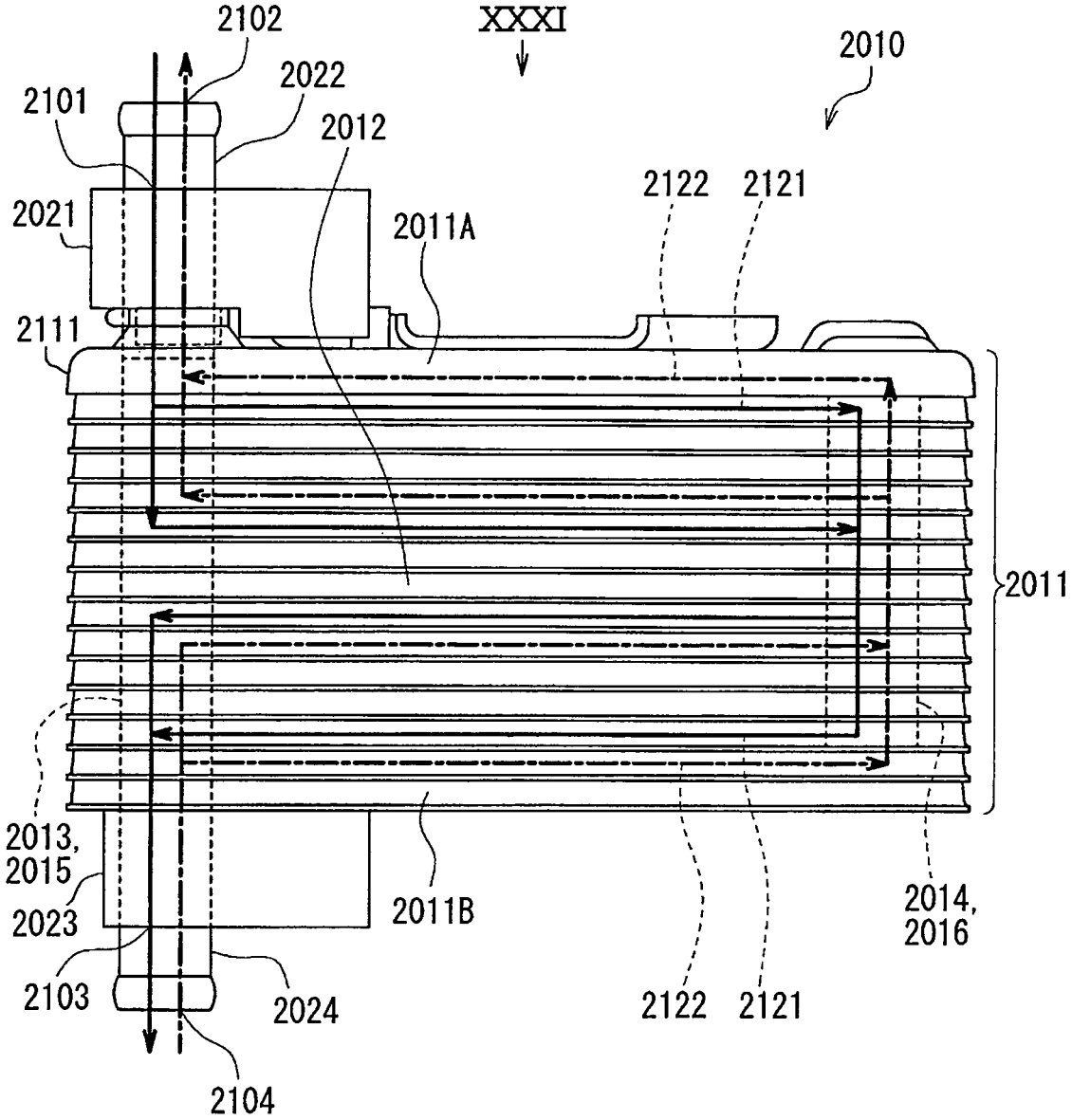
FIG. 30 is a top view illustrating a heat exchanger according to a seventeenth embodiment.
Figure 31:
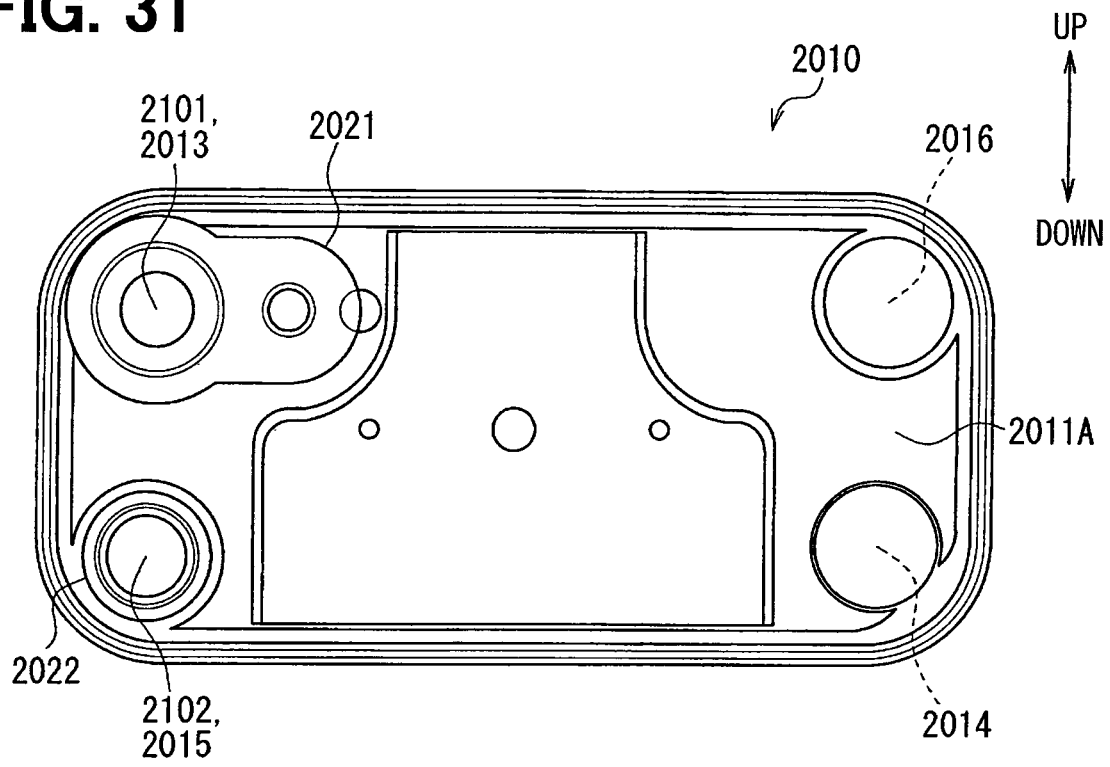
FIG. 31 is an XXXI arrow view of FIG. 30.

The large number of plate members 2011 is arranged in a state where protruding tips of the protruding portions 2111 face the same side (substantially downward in an example of FIG. 30).

The large number of plate members 2011 forms a heat exchanging unit 2012, a refrigerant first tank space 2013, a refrigerant second tank space 2014, a coolant first tank space 2015, and a coolant second tank space 2016. The heat exchanging unit 2012 is configured by multiple refrigerant flow channels 2121 and multiple coolant flow channels 2122.

The multiple refrigerant flow channels 2121 and the multiple coolant flow channels 2122 are formed between the respective multiple plate members 2011. A longitudinal direction of the refrigerant flow channels 2121 and the coolant flow channels 2122 matches a longitudinal direction of the plate members 2011.

The refrigerant flow channels 2121 and the coolant flow channels 2122 are alternately stacked (in parallel) in the plate stacking direction one by one. The plate members 2011 function as partition walls for partitioning the refrigerant flow channels 2121 and the coolant flow channels 2122. A heat exchange between the refrigerant flowing in the refrigerant flow channels 2121 and the coolant flowing in the coolant flow channels 2122 is performed through the plate members 2011.

The refrigerant first tank space 2013 and the coolant first tank space 2015 are arranged on one side (left side in an example of FIG. 30) of the refrigerant flow channels 2121 and the coolant flow channels 2122 with respect to the heat exchanging unit 2012. The refrigerant second tank space 2014 and the coolant second tank space 2016 are arranged on the other side (right side in the example of FIG. 30) of the refrigerant flow channels 2121 and the coolant flow channels 2122 with respect to the heat exchanging unit 2012.

The refrigerant first tank space 2013 and the refrigerant second tank space 2014 distribute and collect the refrigerant with respect to the multiple refrigerant flow channels 2121. The coolant first tank space 2015 and the coolant second tank space 2016 distribute and collect the coolant with respect to the multiple coolant flow channels 2122.

The refrigerant first tank space 2013, the refrigerant second tank space 2014, the coolant first tank space 2015, and the coolant second tank space 2016 are configured by communication holes defined in four corners (four corners of right, left, up, and down in an example of FIG. 31) of the plate members 2011. In this embodiment, the refrigerant first tank space 2013 and the refrigerant second tank space 2014 are defined in two corners on a diagonal in the four corners of the substantially rectangular plate members 2011. The coolant first tank space 2015 and the coolant second tank space 2016 are formed in the remaining two corners.

A first joint 2021 and a first coolant pipe 2022 are fitted to a first endmost plate member 2011A located on the plate stacking direction one end side of the multiple plate members 2011 configuring the heat exchanging unit 2012. The first joint 2021 is a member for joining a refrigerant piping, and forms a refrigerant inlet 2101 of the heat exchanger 2010. The first coolant pipe 2022 provides a coolant outlet 2102 of the heat exchanger 2010.

A second joint 2023 and a second coolant pipe 2024 are fitted to a second endmost plate member 2011B located on the plate stacking direction other end side of the multiple plate members 2011 configuring the heat exchanging unit 2012. The second joint 2023 is a member for joining a refrigerant piping, and forms a refrigerant outlet 2103 of the heat exchanger 2010. The second coolant pipe 2024 provides a coolant inlet 2104 of the heat exchanger 2010.

The refrigerant inlet 2101 and the refrigerant outlet 2103 communicate with the refrigerant first tank space 2013. The coolant outlet 2102 and the coolant inlet 2104 communicate with the coolant first tank space 2015.

Figure 32:
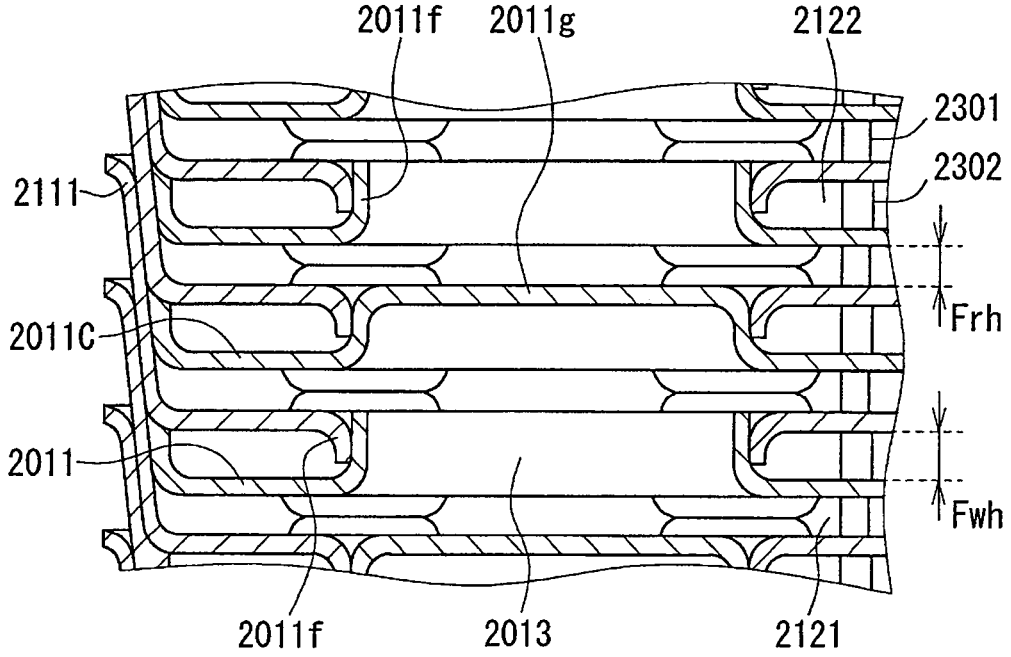
FIG. 32 is a partially cross-sectional view illustrating the heat exchanger according to the seventeenth embodiment.

As illustrated in FIG. 32, in this embodiment, the large number of plate members 2011 configuring the heat exchanging unit 2012 has a substantially cylindrical protruding portion 2011*f* that protrudes toward one end side or the other end side in the plate stacking direction in four corners of the plate members 2011. The refrigerant first tank space 2013, the refrigerant second tank space 2014, the coolant first tank space 2015, and the coolant second tank space 2016 are formed by the protruding portions 2011*f*.

A center plate member 2011C is located substantially in the center of the multiple plate members 2011 configuring the heat exchanging unit 2012 in the plate stacking direction. The center plate member 2011C has a closing portion 2011*g* that closes the protruding portion 2011*f* configuring the refrigerant first tank space 2013. With the above configuration, the refrigerant first tank space 2013 is partitioned into two spaces in the plate stacking direction. The closing portion 2011*g* is formed integrally with the protruding portion 2011*f*, that is, the center plate member 2011C.

Therefore, as indicated by solid arrows in FIG. 30, the refrigerant flowing from the refrigerant inlet 2101 flows in the refrigerant flow channel 2121 from the refrigerant first tank space 2013 toward the refrigerant second tank space 2014 on the one end side in the plate stacking direction. Thereafter, the refrigerant flows in the refrigerant flow channel 2121 from the refrigerant second tank space 2014 toward the refrigerant first tank space 2013 on the other end side in the plate stacking direction, and flows out of the refrigerant outlet 2103. In other words, the heat exchanger 2010 is configured to U-turn a flow of the refrigerant once. In this situation, the closing portion 2011*g* of the center plate member 2011C according to this embodiment corresponds to a U-turn portion.

Although not shown, likewise, in the center plate member 2011C, the protruding portion 2011*f* configuring the coolant first tank space 2015 is closed. With that configuration, the coolant first tank space 2015 is partitioned into two spaces in the plate stacking direction.

Therefore, as indicated by dashed arrows in FIG. 30, the coolant flowing from the coolant inlet 2104 flows in the coolant flow channel 2122 from the coolant first tank space 2015 toward the coolant second tank space 2016 on the other end side in the plate stacking direction. Thereafter, the coolant flows in the coolant flow channel 2122 from the coolant second tank space 2016 toward the coolant first tank space 2015 on the one end side in the plate stacking direction, and flows out of the coolant outlet 2102. In other words, the heat exchanger 2010 is configured to U-turn a flow of the coolant once.

The heat exchanger 2010 is configured so that the flow of refrigerant and the flow of coolant are opposite to each other (counter flow).

Figure 33:
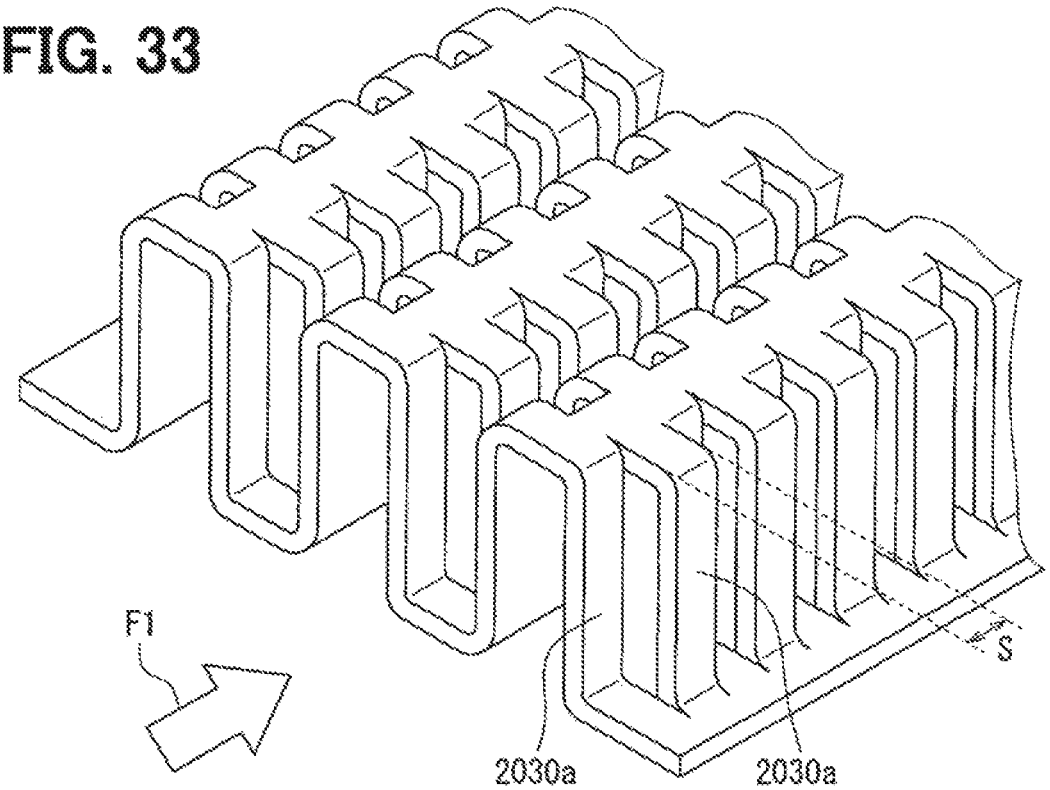
FIG. 33 is a perspective view illustrating an offset fin according to the seventeenth embodiment.

An offset fin illustrated in FIG. 33 is disposed between the respective plate members 2011. The offset fin is an inner fin that is interposed between the respective plate members 2011, and facilitates the heat exchange between the refrigerant and the heat medium.

The offset fin is a plate-like member in which cut-and-raised parts 2030*a* that are partially cut and raised are formed. A large number of the cut-and-raised parts 2030*a* are formed in a direction F1 (longitudinal direction of the plate members 2011) which is in parallel to the flowing direction of refrigerant and coolant.

The cut-and-raised parts 2030*a* adjacent to each other in the direction F1 parallel to the flowing direction of the refrigerant and the coolant offset each other. In an example of FIG. 33, the large number of cut-and-raised parts 2030*a* are staggered in the direction Fl parallel to the flowing direction of the refrigerant and the coolant.

For example, a two-sided clad material obtained by cladding a brazing material on both surfaces of an aluminum core is used as a specific material of the offset fin. The offset fin is joined to both of the adjacent plate members 2011 by brazing.

Therefore, the offset fin configures an inner wall that joins the adjacent plate members 2011 together, and crosses the refrigerant flow channels 2121 and the coolant flow channels 2122 in the plate stacking direction. A length (hereinafter called "flow path height") of the refrigerant flow channels 2121 and the coolant flow channels 2122 in the plate stacking direction is equal to a length of the offset fin disposed in the refrigerant flow channels 2121 and the coolant flow channels 2122 in the plate stacking direction.

There are two different types of offset fins disposed in the refrigerant flow channels 2121 and the coolant flow channels 2122. Hereinafter, the offset fin disposed in the refrigerant flow channels 2121 is referred to as "refrigerant side offset fin 2301", and the offset fin disposed in the coolant flow channels 2122 is referred to as "coolant side offset fin 2302".

A height of the refrigerant side offset fin 2301 in the plate stacking direction is referred to herein as the "fin height Frh of the refrigerant side offset fin 2301". A height of the coolant side offset fin 2302 in the plate stacking direction is referred to herein as the "fin height Fwh of the coolant side offset fin 2302".

In embodiments of the present disclosure, the height Frh of the refrigerant side offset fin 2301 is lower than the height Fwh of the coolant side offset fin 2302. For that reason, the flow path height of the refrigerant flow channels 2121 is lower than the flow path height of the coolant flow channels 2122.

The present inventors have studied a change in heat transfer performance and pressure loss when changing the height Frh of the refrigerant side offset fin 2301 relative to the fixed height Fwh of the coolant side offset fin 2302.

Figure 34:
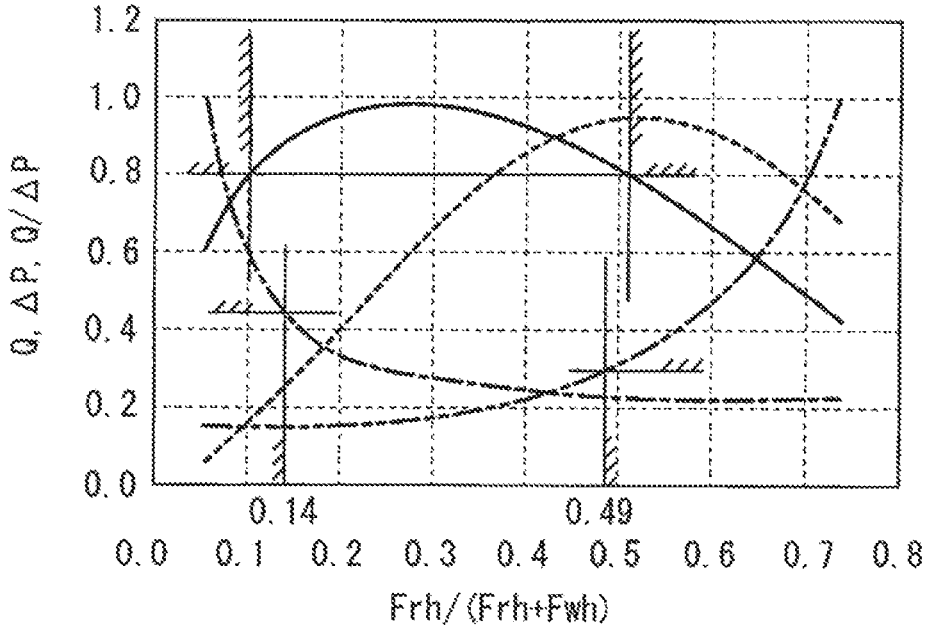
FIG. 34 is a characteristic view illustrating a relationship between a fin height of the offset fin and a heat transfer performance or a pressure loss.

When one refrigerant side offset fin 2301 and one coolant side offset fin 2302 are provided as one set, the heat transfer performance, or the pressure loss of the refrigerant or the coolant, is related to a ratio (Frh/(Frh+Fwh)), as illustrated in FIG. 34. The ratio Frh/(Frh+Fwh) is a ratio of the fin height of the refrigerant side offset fin 2301 to a total fin height (Frh+Fwh) of the set. In FIG. 34, the vertical axis is labeled as Q, ΔP, Q/ΔP, with Q representing heat transfer performance, ΔP representing pressure loss, and Q/ΔP representing an index defined by dividing Q by ΔP.

Referring to FIG. 34, the dashed line represents the pressure loss of the refrigerant, the two-dot chain line presents the pressure loss of the coolant, and the solid line represents the heat transfer performance between the coolant and the refrigerant. The dashed line in FIG. 34 represents, as a comparative example, the heat transfer performance between oil and the coolant when the refrigerant in this embodiment is replaced with oil, that is, in an oil cooler that performs the heat exchange between the oil and the coolant to cool the oil.

As indicated by the solid line in FIG. 34, the ratio of the fin height of the refrigerant side offset fin 2301 to a total fin height (Frh+Fwh) is shown for ranges from 0.1 to 0.5 with the results that the heat transfer performance between the refrigerant and the coolant can be increased to about 80 percentages or higher of the highest value. When the refrigerant side offset fin 2301 has the same height as the coolant side offset fin 2302, Frh/(Frh+Fwh) is equal to 0.5. When Frh is larger than Fwh, Frh/(Frh+Fwh) is less than 0.5. When Frh is less than Fwh, Frh/(Frh+Fwh) is greater than 0.5.

As represented by the one-dot chain line in FIG. 34, when the ratio of the fin height of the refrigerant side offset fin 2301 2301 to a total fin height (Frh+Fwh) is equal to or smaller than 0.14, the pressure loss of the refrigerant rapidly increases. As represented by the two-dot chain line in FIG. 34, when the ratio of the fin height of the refrigerant side offset fin 2301 to a total fin height (Frh+Fwh) is equal to or larger than 0.49, the pressure loss of the coolant rapidly increases.

Therefore, the ratio of the fin height of the refrigerant side offset fin 2301 to a total fin height (Frh+Fwh) is set to be larger than 0.14 and smaller than 0.49. In other words, the ratio of the fin height of the refrigerant side offset fin 2301 to a total fin height (Frh+Fwh) is set to satisfy a relationship of $0.14<Frh/(Frh+Fwh)<0.49$. As a result, the heat transfer performance between the refrigerant and the coolant can be improved with a reduction in the pressure loss of the refrigerant and the coolant.

As represented by the dashed line in FIG. 34, in the oil cooler of the comparative example, in a region where the ratio of the fin height of the refrigerant side offset fin 2301 to a total fin height (Frh+Fwh) is equal to or larger than 0.5, which falls outside of the optimum range described above, the highest value of the heat transfer performance between the oil and the coolant occurs. For that reason, in the heat exchanger that performs the heat exchange between the refrigerant and the coolant, it is effective that the fin height of the refrigerant side offset fin 2301 and the coolant side offset fin 2302 satisfies a relationship of $0.14<Frh/(Frh+Fwh)<0.49$.

In this example, as illustrated in FIG. 33, a length of the cut-and-raised parts 2030*a* of the refrigerant side offset fin 2301 in the flowing direction of the refrigerant is referred to as "segment length 5". As the segment length S is larger, the diffusivity of the refrigerant in the refrigerant flow channels 2121 is deteriorated more. For that reason, in this embodiment, the segment length S of the refrigerant side offset fin 2301 is set to 1/80 of a refrigerant flow channel length L or smaller, that is, L/80 or smaller. With that configuration, since the refrigerant excellently diffuses on the refrigerant flow channels 2121, the occurrence of drift can be suppressed. Since the diffusivity of the refrigerant in the refrigerant flow channels 2121 is improved more as the segment length S is shorter, it is preferable to shorten the segment length S to a manufacturing limit as much as possible.

Subsequently, the present inventors have studied a change in the pressure loss of the refrigerant in changing a shape of the refrigerant flow channels 2121.

Figure 35:
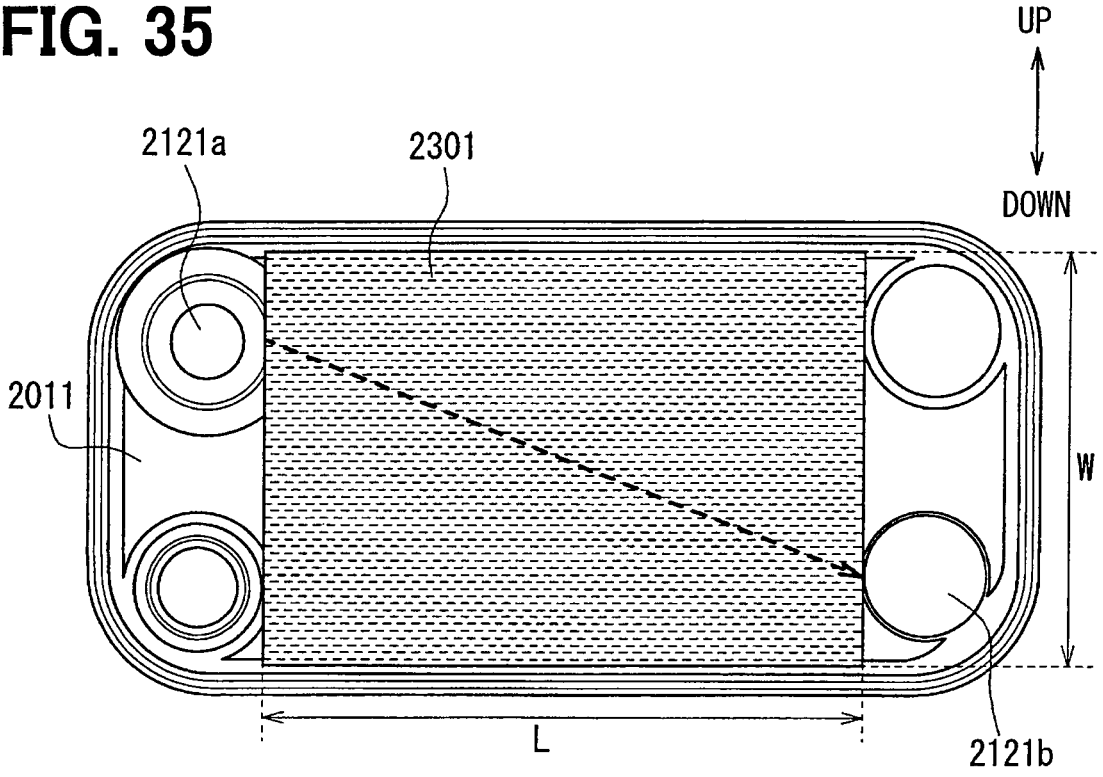
FIG. 35 is a front view illustrating a plate member according to the seventeenth embodiment.

As illustrated in FIG. 35, a ratio (L/W) of a length (hereinafter referred to as "refrigerant flow path length") L of the refrigerant flow channels 2121 in the flowing direction of the refrigerant to a length W of the refrigerant flow channels 2121 in a direction (hereinafter referred to as "widthwise direction of the refrigerant flow channels 2121") orthogonal to both of the flowing direction of the refrigerant and the plate stacking direction is set as an aspect ratio.

Figure 36:
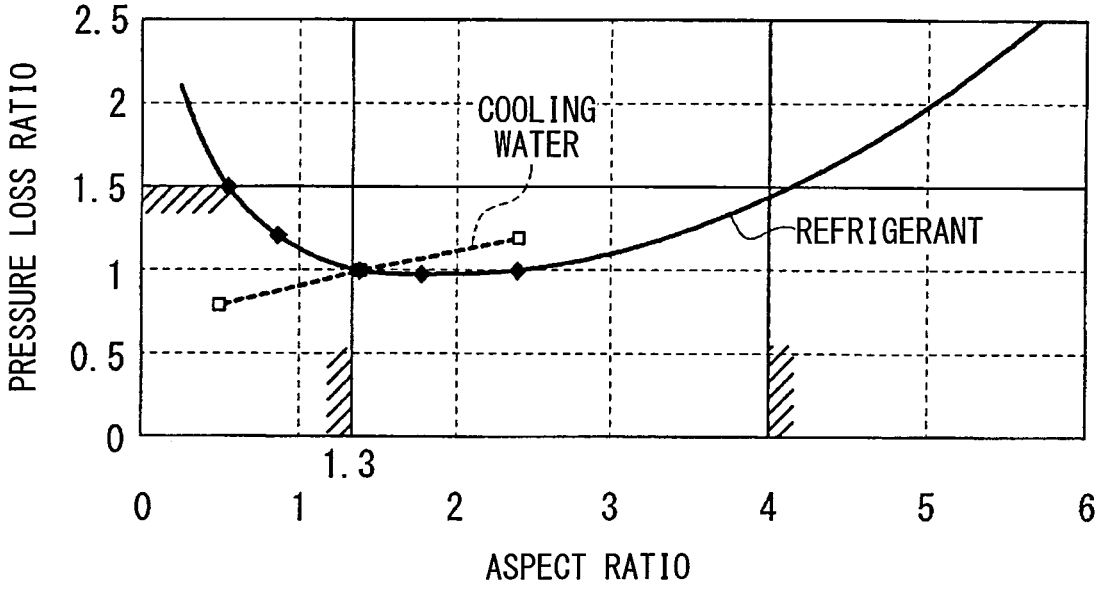
FIG. 36 is a characteristic view illustrating a relationship between an aspect ratio and a pressure loss of a refrigerant flow channel or a coolant flow channel.

A relationship of the aspect ratio of the refrigerant flow channel 2121 or the coolant flow channel 2122 to the pressure loss when the segment length S of the refrigerant side offset fin 2301 is set to L/80 or smaller is illustrated in FIG. 36. In this case, the fin height of the refrigerant side offset fin 2301 is set to 1.5 mm. Referring to FIG. 36, a solid line represents a relationship between the aspect ratio of the refrigerant flow channel 2121 and the pressure loss, and a dashed line represents a relationship between the aspect ratio of the coolant flow channel 2122 and the pressure loss.

Because the coolant is high in viscosity, the coolant is diffused in the coolant flow channels 2122 due to the viscosity of the coolant itself. For that reason, the pressure loss of the coolant in the coolant flow channels 2122 depends on the flow path length. Hence, as indicated by a dashed line in FIG. 36, the pressure loss of the coolant increases more as the aspect ratio of the coolant flow channels 2122 is larger.

On the other hand, since a gaseous refrigerant is low in the viscosity, the gaseous refrigerant is unlikely to diffuse into the refrigerant flow channels 2121, and the drift is likely to be generated. On the contrary, as indicated by a solid line in FIG. 36, the segment length S of the refrigerant side offset fin 2301 is set to be equal to or smaller than L/80, and the aspect ratio of the refrigerant flow channels 2121 is set to be equal to or larger than 1.3, as a result of which the generation of the drift can be suppressed, and the pressure loss of the refrigerant can be reduced.

Incidentally, in the refrigeration cycle, because a coefficient of performance (COP) of the cycle is deteriorated more as the pressure loss of the refrigerant is larger, it is desirable to reduce the pressure loss. As with the coolant flow channels 2122, in the refrigerant flow channels 2121, the pressure loss increases more as the flow path length is longer in a region where the aspect ratio of the refrigerant flow channels 2121 is equal to or larger than 1.3.

In practical use, it is desirable that the pressure loss of the refrigerant falls within 1.5 times of the minimum pressure loss. When the pressure loss of the refrigerant is 1.5 times of the minimum pressure loss, the COP is deteriorated by 5% of the maximum COP. As the aspect ratio of the refrigerant flow channels 2121 becomes larger, a body size of the heat exchanger 2010 is upsized more. Therefore, for the purpose of suppressing a reduction in the COP and downsizing the body size of the heat exchanger 2010, it is desirable that the aspect ratio of the refrigerant flow channels 2121 is set to be equal to or smaller than 4.

Incidentally, the heat exchanging unit 2012 according to this embodiment is disposed in a state where the plate stacking direction intersects with the gravity direction. Specifically, the heat exchanging unit 2012 is disposed in a state where a widthwise direction of the refrigerant flow channels 2121 becomes in parallel to the gravity direction.

In the heat exchanging unit 2012, the refrigerant performs a heat exchange with the coolant, to thereby be condensed and evaporated. When the refrigerant is condensed and evaporated, the heat transmitting rate is improved more as a liquid film of the heat transfer surface is thinner.

As illustrated by a dashed arrow in FIG. 35, in the refrigerant flow channel 2121, the refrigerant flows from a refrigerant inflow portion 2121*a* for allowing the refrigerant to flow into the refrigerant flow channel 2121 toward a refrigerant outlet portion 2121*b* for allowing the refrigerant to flow out of the refrigerant flow channel 2121.

In the heat exchanger 2010 according to a comparative example in which the flow of refrigerant circulating in the refrigerant flow channel 2121 is not U-turned, a liquid-phase refrigerant of a gas-liquid two phase refrigerant diffused into the refrigerant flow channel 2121 from the refrigerant inflow portion 2121*a* is attached to the refrigerant side offset fin 2301, and stays. Because a gas-phase refrigerant is likely to flow in a portion where the liquid-phase refrigerant does not stay, the drift is generated. Once the drift is generated, since an improvement is difficult, the drift is kept to be generated in all of the refrigerant flow channels 2121, and the heat transmitting rate is lowered.

On the contrary, in the heat exchanger 2010 according to this embodiment, in the refrigerant flow channels 2121 before being U-turned, the liquid-phase refrigerant is attached to the refrigerant side offset fin 2301, and stays. The liquid-phase refrigerant moves downward in the gravity direction due to a gas-liquid density difference, and is congregated in the refrigerant outlet portion 2121*b*. Then, in the refrigerant flow channels 2121 after being U-turned, the refrigerant of the gas-liquid two phase state is again diffused from the refrigerant inflow portion 2121*a*. As with the refrigerant flow channels 2121 before the U-turn, in the refrigerant flow channels 2121 after being U-turned, the liquid-phase refrigerant is attached to the refrigerant side offset fin 2301, and stays. The liquid-phase refrigerant moves downward in the gravity direction due to a gas-liquid density difference, and is congregated in the refrigerant outlet portion 2121*b*.

As described above, the flow of refrigerant flowing in the refrigerant flow channel 2121 is U-turned. As a result, after the refrigerant diffused once is congregated in the refrigerant flow channel 2121 before being U-turned, the refrigerant can be further diffused in the refrigerant flow channel 2121 after being U-turned. Further, the heat exchanging unit 2012 is disposed in a state where the plate stacking direction intersects with the gravity direction whereby the liquid-phase refrigerant can be separated by the gas-liquid density difference. With the above configuration, the heat transfer performance can be improved by ensuring the flow path area (effective heat transfer surface) of the refrigerant flow channel 2121 in which the gas-phase refrigerant flows. For that reason, the heat exchanging performance can be improved.

OTHER EMBODIMENTS

The present disclosure is not limited to the above-mentioned embodiments, and may have various modifications as described below without departing from the gist of the present disclosure.

For example, in the auxiliary systems 30, 50, and 70, a heat medium such as oil may be circulated instead of the coolant mainly containing water.

The fin 41*f* may be disposed in only the refrigerant passages 41*rf* for the refrigerant. In that case, any fin may not be provided, or a fin with no slit may be provided in the water passages 41*wt* for water.

In the above embodiments, a part of the connection members is provided by a pipe-shaped connector. Instead, all of the connection members may be provided by block joints.

In the above seventeenth embodiment, the cooling water is used as the heat medium. However, the heat medium is not limited to this example. For example, the refrigerant is employed as the heat medium, and the respective refrigerants may perform the heat exchange with each other in the heat exchanging unit 2012.

In the seventeenth embodiment, the heat exchanging unit 2012 is arranged in a state where the widthwise direction of the refrigerant flow channels 2121 is in parallel to the gravity direction. However, the arrangement direction of the heat exchanging unit 2012 is not limited to this example. For example, the heat exchanging unit 2012 is arranged in a state where the plate stacking direction intersects with the gravity direction with the results that the liquid-phase refrigerant is congregated on a lower side in the gravity direction due to the gas-liquid density difference, and the effective heat transfer surface can be ensured in the refrigerant flow channels 2121.

In the seventeenth embodiment, the refrigerant flow channels 2121 and the coolant flow channels 2122 are alternately stacked on each other in the plate stacking direction one by one. For example, the refrigerant flow channels 2121 and the coolant flow channels 2122 may be alternately stacked on each other in the plate stacking direction by multiple paths.

In the seventeenth embodiment, the heat exchanger 2010 is configured so that the flow of refrigerant and the flow of coolant are U-turned once, but may be configured so that the flow of refrigerant and the flow of coolant are U-turned by multiple times.

The heat exchanger 2010 may be configured so that the flow of refrigerant and the flow of coolant are not U-turned. In that case, the heat exchanging unit 2012 may be disposed in an arbitrary orientation.

In the seventeenth embodiment, the heat exchanger 2010 is configured so that the flow of refrigerant and the flow of coolant are in opposite directions to each other (counter flow). Alternatively, the heat exchanger 2010 may be configured so that the flow of refrigerant and the flow of coolant are in the same directions as each other (parallel flow).

What is claimed is:

1. A stacked heat exchanger, comprising:

a heat exchanging unit that performs a heat exchange between a refrigerant of a refrigeration cycle and a coolant, wherein the heat exchanging unit is configured such that the refrigerant and the coolant flow in opposite directions from each other throughout the heat exchanging unit, the heat exchanging unit is formed by stacking a plurality of plate members on each other, and joining adjacent plate members of the plurality of plate members to each other, a plurality of refrigerant flow channels in which the refrigerant flows, and a plurality of heat medium flow channels in which the coolant flows, the plurality of refrigerant flow channels and the plurality of heat medium flow channels are arranged side by side in a stacking direction of the plurality of plate members, inner fins that join adjacent plate members to each other and facilitate a heat exchange between the refrigerant and the coolant, are disposed in each of the plurality of refrigerant flow channels and each of the plurality of heat medium flow channels, each of the inner fins disposed in the plurality of refrigerant flow channels is a refrigerant side offset fin in which a first plurality of cut-and-raised parts which are partially cut and raised are formed in a flowing direction of the refrigerant, and the cut-and-raised parts adjacent to each other in the flowing direction of the refrigerant offset each other, each of the inner fins disposed in the plurality of heat medium flow channels is a heat medium side offset fin in which a second plurality of cut-and-raised parts which are partially cut and raised are formed in a flowing direction of the coolant, and the cut-and-raised parts adjacent to each other in the flowing direction of the heat medium offset each other, a refrigerant flow path height which is a length of one of the plurality of refrigerant flow channels in the stacking direction of the plurality of plate members is equal to a refrigerant side fin height Frh which is a length of the refrigerant side offset fin in the stacking direction of the plurality of plate members, a heat medium flow path height which is a length of one of the plurality of heat medium flow channels in the stacking direction of the plurality of plate members is equal to a heat medium side fin height Fwh which is a length of the heat medium side offset fin in the stacking direction of the plurality of plate members, the refrigerant side fin height Frh and the heat medium side fin height Fwh are configured to satisfy a relationship of $0.14<Frh/(Frh+Fwh)<0.49$, one of a plurality of refrigerant side offset fins is disposed in each of the plurality of refrigerant flow channels, and one of a plurality of heat medium side offset fins is disposed in each of the plurality of heat medium flow channels.

2. The stacked heat exchanger according to claim 1, wherein an aspect ratio which is a ratio of a length of the plurality of refrigerant flow channels in a flowing direction of the refrigerant to a length of the plurality of refrigerant flow channels in a direction orthogonal to both of the flowing direction of the refrigerant and the stacking direction of the plurality of plate members is set to be larger than or equal to 1.3, and a length of the cut-and-raised parts of the first plurality of cut-and-raised parts of the refrigerant side offset fin in the flowing direction of the refrigerant in each of the refrigerant flow channels is set to be smaller than or equal to 1/80 of the length of the plurality of refrigerant flow channels in the flowing direction.

3. The stacked heat exchanger according to claim 1, wherein the heat exchanging unit is disposed in a state where the stacking direction of the plurality of plate members intersects with a gravity direction, and the heat exchanging unit has a U-turn portion that U-turns the flow of the refrigerant circulating in the plurality of refrigerant flow channels.

4. The stacked heat exchanger according to claim 1, wherein:

the heat exchanging unit is disposed in a state where the stacking direction of the plurality of plate members intersects with a gravity direction, the heat exchanging unit has a U-turn portion that U-turns the flow of the refrigerant circulating in the plurality of refrigerant flow channels, a flow of the refrigerant and a flow of the coolant are parallel to each other throughout the heat exchanging unit, the refrigerant in the plurality of refrigerant flow channels is in a gas-liquid two phase state that includes gas-phase refrigerant and liquid-phase refrigerant, and the U-turn portion in the plurality of refrigerant flow channels causes the refrigerant to repeatedly congregate and diffuse.

5. The stacked heat exchanger according to claim 1, wherein the refrigerant side fin height Frh is smaller than the heat medium side fin height Fwh.

6. The stacked heat exchanger according to claim 4, wherein the refrigerant side fin height Frh is smaller than the heat medium side fin height Fwh.

* * * * *